US012663222B2

(12) United States Patent
Onaka et al.

(10) Patent No.: US 12,663,222 B2
(45) Date of Patent: Jun. 23, 2026

(54) HEAT EXCHANGER AND REFRIGERATION CYCLE APPARATUS

(71) Applicant: Mitsubishi Electric Corporation, Tokyo (JP)

(72) Inventors: Yoji Onaka, Tokyo (JP); Rihito Adachi, Tokyo (JP); Nanami Kishida, Tokyo (JP); Taisaku Gomyo, Tokyo (JP); Tetsuji Saikusa, Tokyo (JP); Yuki Nakao, Tokyo (JP); Atsushi Kibe, Tokyo (JP); Hiroyuki Morimoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 286 days.

(21) Appl. No.: 18/281,567

(22) PCT Filed: Feb. 17, 2022

(86) PCT No.: PCT/JP2022/006367
§ 371 (c)(1),
(2) Date: Sep. 12, 2023

(87) PCT Pub. No.: WO2022/219919
PCT Pub. Date: Oct. 20, 2022

(65) Prior Publication Data

US 2024/0159474 A1 May 16, 2024

(30) Foreign Application Priority Data

Apr. 13, 2021 (WO) ..... PCT/JP2021/015325

(51) Int. Cl.
*F28F 1/12* (2006.01)
*F25B 39/00* (2006.01)
(Continued)

(52) U.S. Cl.
CPC ..... *F28F 1/12* (2013.01); *F25B 39/00* (2013.01); *F28F 1/04* (2013.01); *F28F 1/128* (2013.01); *F28F 17/005* (2013.01); *F25B 39/02* (2013.01)

(58) Field of Classification Search
CPC .. F28F 17/005; F28F 1/128; F28F 1/12; F28F 1/04
See application file for complete search history.

(56) References Cited

U.S. PATENT DOCUMENTS 5,033,540 A 7/1991 Tategami et al.
5,992,514 A * 11/1999 Sugimoto ..... F28F 9/001 165/149
(Continued)

FOREIGN PATENT DOCUMENTS

EP 3 587 988 A1 1/2020
JP S54-055756 U 4/1979
(Continued)

OTHER PUBLICATIONS

Extended European Search Report dated May 6, 2024 issued in corresponding European patent application No. 21936921.2, 8pp.
(Continued)

*Primary Examiner* — Paul Alvare
(74) *Attorney, Agent, or Firm* — XSENSUS LLP

(57) ABSTRACT

A heat exchanger includes a plurality of flat heat-transfer tubes and a corrugated fin placed between the plurality of flat heat-transfer tubes. Louvers in fin sections of the corrugated fin are divided into a first louver group formed further upstream in a direction of flow of air than a drain slit in the corrugated fin and a second louver group formed further downstream in the direction of flow of air than the drain slit. Plate portions of the first louver group and plate portions of the second louver group are inclined to a flat-plate portion in the fin sections and inclined in respective directions that are
(Continued)

opposite to each other. The drain slit includes a plurality of drain slits formed between the first louver group and the second louver group at an interval in the direction of flow of air.

17 Claims, 33 Drawing Sheets

(51) Int. Cl.

| | |
|---|---|
| ***F28F 1/04*** | (2006.01) |
| ***F28F 17/00*** | (2006.01) |
| *F25B 39/02* | (2006.01) |

(56) References Cited

U.S. PATENT DOCUMENTS

| | | | | |
|---|---|---|---|---|
| 6,308,527 | B1 | 10/2001 | Kuroyanagi et al. | |
| 2001/0035284 | A1* | 11/2001 | Iwasaki | F28D 1/0435 165/135 |
| 2006/0237173 | A1* | 10/2006 | Okura | F28D 1/0408 165/135 |
| 2007/0084589 | A1* | 4/2007 | Nishino | F28D 1/05391 165/152 |
| 2011/0139414 | A1* | 6/2011 | Ghosh | F28F 1/128 165/172 |
| 2017/0082381 | A1* | 3/2017 | Sugimura | F28F 1/128 |
| 2018/0328627 | A1* | 11/2018 | Akaiwa | F28D 1/0452 |
| 2019/0049162 | A1* | 2/2019 | Akaiwa | F25B 39/02 |
| 2020/0103148 | A1* | 4/2020 | Matsumoto | F28D 1/053 |

FOREIGN PATENT DOCUMENTS

| | | | |
|---|---|---|---|
| JP | H03-177795 | A | 8/1991 |
| JP | H09-061081 | A | 3/1997 |
| JP | 2010-025482 | A | 2/2010 |
| JP | 4456750 | B2 | 2/2010 |
| JP | 4683987 | B2 | 5/2011 |
| JP | 2015-183908 | A | 10/2015 |
| JP | 2020-133991 | A | 8/2020 |
| JP | 6734002 | B1 | 8/2020 |
| WO | 2018/154806 | A1 | 8/2018 |
| WO | 2020/170651 | A1 | 8/2020 |

OTHER PUBLICATIONS

International Search Report and Written Opinion mailed on Mar. 29, 2022, received for PCT Application PCT/JP2022/006367, filed on Feb. 17, 2022, 13 pages including English Translation.

International Search Report and Written Opinion mailed on May 25, 2021, received for PCT Application PCT/JP2021/015325, filed on Apr. 13, 2021, 10 pages including English Translation.

* cited by examiner (a)

(b)

Comparative Example

HEAT EXCHANGER AND REFRIGERATION CYCLE APPARATUS

CROSS-REFERENCE TO RELATED APPLICATIONS

The present application is based on PCT filing PCT/JP2022/006367, filed Feb. 17, 2022, which claims priority from PCT filing PCT/JP2021/015325, filed Apr. 13, 2021, the entire contents of each are incorporated herein by reference.

TECHNICAL FIELD

The present disclosure relates to a heat exchanger including a corrugated fin and to a refrigeration cycle apparatus.

BACKGROUND ART

For example, corrugated-fin-tube-type heat exchangers formed by alternately stacking flat heat-transfer tubes and corrugated fins are widespread. In a case in which such a heat exchanger is used as an evaporator, the surface temperature of a corrugated fin becomes lower than or equal to a freezing point, so that condensed water on a fin surface may freeze. The freezing of the condensed water on the fin surface mounts resistance to air passing through the heat exchanger, causing a deterioration in heat-transfer performance of the corrugated fin. To address this problem, there is a heat exchanger provided with a drain slit formed by a through hole in a corrugated fin so that condensed water on a fin surface is drained through the drain slit (see, for example, Patent Literature 1). It should be noted that the term "condensed water" refers to water having adhered to a surface of the heat exchanger as a result of condensation of moisture in the air.

CITATION LIST

Patent Literature

Patent Literature 1: Japanese Unexamined Patent Application Publication No. 2015-183908

SUMMARY OF INVENTION

Technical Problem

Although the heat exchanger of Patent Literature 1 has a drain slit through which condensed water on a fin surface is drained, enlarging an opening of the drain slit for improvement in drainage capacity invites a deterioration in heat-transfer performance due to a reduction in heat-transfer area while bringing about improvement in drainage capacity. The heat exchanger of Patent Literature 1 had room for improvement in terms of improving drainage capacity while maintaining heat-transfer performance.

To solve problems such as those noted above, the present disclosure has as an object to provide a heat exchanger that makes it possible to improve drainage capacity while maintaining heat-transfer performance and a refrigeration cycle apparatus.

Solution to Problem

A heat exchanger according to an embodiment of the present disclosure includes a plurality of flat heat-transfer tubes each formed in a flat shape in cross-section, provided with a plurality of flow passages formed by through holes, disposed to stand in an up-down direction, and placed side by side and spaced from one another in a direction orthogonal to a direction of flow of air; and a corrugated fin placed between the plurality of flat heat-transfer tubes. The corrugated fin is formed such that fin sections that are plate-shaped are joined together one after another in a wave shape in a tube axial direction of the plurality of flat heat-transfer tubes, the fin sections each have a drain slit formed such that the drain slit extends in a tube side-by-side placement direction that is a direction in which the plurality of flat heat-transfer tubes are placed side by side and through which water on an upper surface of the fin section falls for drainage, and a plurality of louvers each having a louver slit extending in the tube side-by-side placement direction and a plate portion inclined to a flat-plate portion that is tabular-shaped in the fin section, the plurality of louvers are divided into a first louver group formed further upstream in the direction of flow of air than the drain slit and a second louver group formed further downstream in the direction of flow of air than the drain slit, the plate portions of the first louver group and the plate portions of the second louver group are inclined to the flat-plate portion and inclined in respective directions that are opposite to each other, and the drain slit includes a plurality of drain slits formed between the first louver group and the second louver group at an interval in the direction of flow of air.

Further, a refrigeration cycle apparatus according to an embodiment of the present disclosure includes the aforementioned heat exchanger.

Advantageous Effects of Invention

In the heat exchanger according to an embodiment of the present disclosure, a plurality of drain slits are formed at an interval in the direction of flow of air between the first louver group and the second louver group. Moreover, the first louver group formed upstream of the plurality of drain slits in the direction of flow of air and the second louver group formed downstream of the plurality of drain slits in the direction of flow of air are inclined in opposite directions. For this reason, the heat exchanger according to an embodiment of the present disclosure makes it possible to improve drainage capacity while maintaining heat-transfer performance.

DESCRIPTION OF EMBODIMENTS

Figure 1:
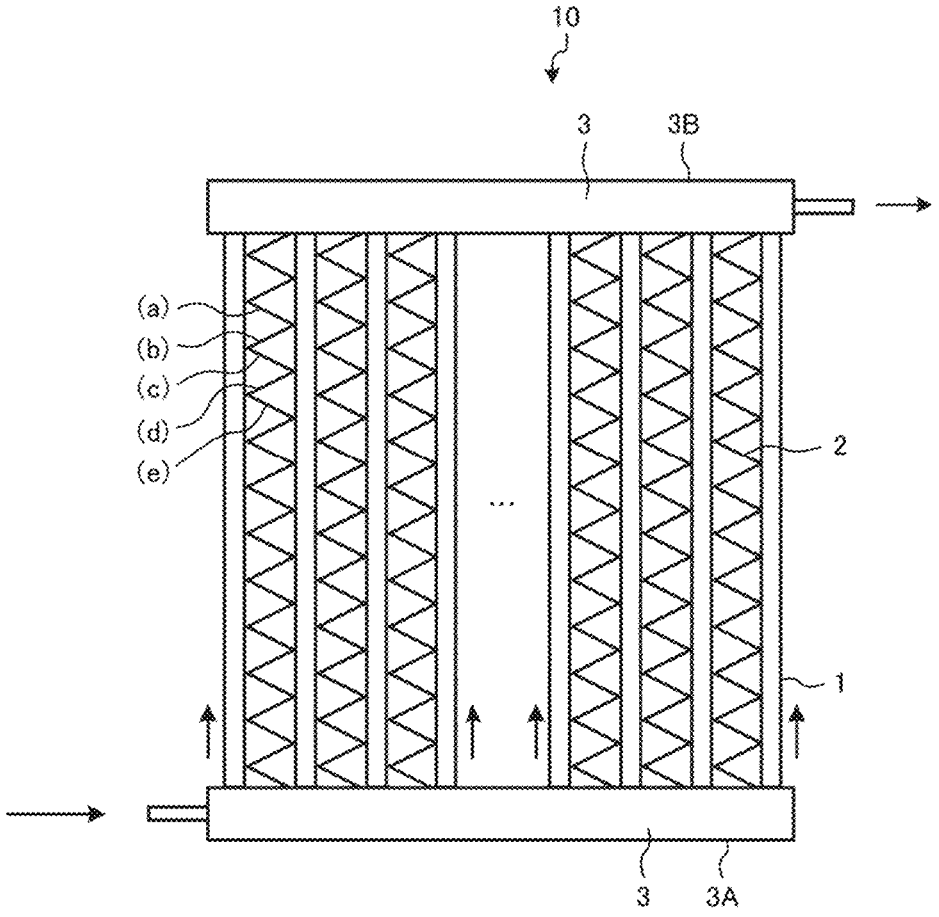
FIG. 1 is a diagram illustrating a configuration of a heat exchanger according to Embodiment 1.

In the following, heat exchangers and a refrigeration cycle apparatus according to embodiments are described, for example, with reference to the accompanying drawings. Further, constituent elements given identical reference signs in the following drawings are identical or equivalent to each other, and these reference signs are adhered to throughout the full text of the embodiments described below. Moreover, the forms of constituent elements expressed in the full text of the specification are merely examples and are not limited to forms described herein. In particular, a combination of constituent elements is not limited solely to a combination in one embodiment, but constituent elements described in one embodiment can be applied to another embodiment. Further, in the following description, an upper part of a drawing is described as an "upper side", and a lower part of a drawing is described as a "lower side". Furthermore, directive terms (such as "right" and "left") used to promote understanding are intended for descriptive purposes and are not intended to limit the present disclosure. Further, how high or low temperatures and humidities are is not determined in relation to particularly absolute values but relatively determined according to states, actions, or other conditions in apparatuses or other devices. Moreover, relationships in size between one constituent element and another in the drawings may be different from actual ones.

Embodiment 1

FIG. 1 is a diagram illustrating a configuration of a heat exchanger according to Embodiment 1. As shown in FIG. 1, the heat exchanger 10 of Embodiment 1 is a parallel-pipe corrugated-fin-tube-type heat exchanger. The heat exchanger 10 includes a plurality of flat heat-transfer tubes 1, a plurality of corrugated fins 2, and a pair of headers 3.

The pair of headers 3 are each a tube that is connected by pipes to other devices included in a refrigeration cycle apparatus, into and out of which refrigerant flows, and that causes the refrigerant to be divided or merged. The refrigerant is a fluid that serves as a heat exchange medium. The pair of headers 3 include a header 3A and a header 3B. The header 3A and the header 3B are placed one above the other and spaced from one another. In a case in which the heat exchanger 10 is used as an evaporator, liquid refrigerant passes through the upper header 3B, and gas refrigerant passes through the lower header 3A. In a case in which the heat exchanger 10 is used as a condenser, gas refrigerant passes through the upper header 3B, and liquid refrigerant passes through the lower header 3A.

Between the two headers 3, the plurality of flat heat-transfer tubes 1 are placed perpendicular to each header 3, and the plurality of flat heat-transfer tubes 1 are placed parallel to one another. The plurality of flat heat-transfer tubes 1 are placed side by side and equally spaced from one another in a direction orthogonal to a direction of flow of air. In the following, the direction (right-left direction in FIG. 1) in which the flat heat-transfer tubes 1 are placed side by side is referred to as "tube side-by-side placement direction", and the axial direction (up-down direction in FIG. 1) of the flat heat-transfer tubes 1 is referred to as "tube axial direction".

Each of the flat heat-transfer tubes 1 has a flat shape in cross-section. Each of the flat heat-transfer tubes 1 is a heat-transfer tube of which an outer surface (hereinafter referred to as "flat surface") of a long side of the flat cross-section has the shape of a planar surface and of which an outer surface of a short side of the flat shape has the shape of a curved surface. Each of the flat heat-transfer tubes 1 is a multi-hole heat-transfer tube having a plurality of refrigerant flow passages formed by through holes inside the tube. The flat heat-transfer tubes 1 are each disposed to stand in the up-down direction, have their through holes extending in the up-down direction, and communicate with the two headers 3. Each of the flat heat-transfer tubes 1 is placed so that a long side of the flat cross-section extends along the direction of flow of air. Each flat heat-transfer tube 1 is joined to the two headers 3 by having both ends inserted in and brazed to insertion holes (not illustrated) opened separately in each of the two headers 3. A usable example of a brazing filler metal is an aluminum-containing brazing filler metal.

Note here that in a case in which the heat exchanger 10 is used as an evaporator, low-temperature and low-pressure refrigerant flows through the refrigerant flow passages inside the flat heat-transfer tubes 1. In a case in which the heat exchanger 10 is used as a condenser, high-temperature and high-pressure refrigerant flows through the refrigerant flow passages inside the flat heat-transfer tubes 1. The arrows in FIG. 1 indicate the flow of refrigerant in a case in which the heat exchanger 10 is used as an evaporator.

Embodiment 1 is intended to describe drainage of condensed water that is produced on fin surfaces in a case in which the heat exchanger 10 is used as an evaporator For this reason, the following describes the flow of refrigerant in the heat exchanger 10 in a case in which the heat exchanger 10 is used as an evaporator. As indicated by the arrows in FIG. 1, the refrigerant flows into the header 3A via a pipe (not illustrated) through which the refrigerant is supplied from an external device (not illustrated) to the heat exchanger 10. The refrigerant having flowed into the header 3A is distributed and passes through each flat heat-transfer tube 1. The flat heat-transfer tube 1 exchanges heat between the refrigerant passing through the inside of the tube and outside air that is external atmospheric air passing through outside the tube. At this time, the refrigerant removes heat from the atmospheric air while passing through the flat heat-transfer tube 1. The refrigerant subjected to heat exchange through each flat heat-transfer tube 1 flows into the header 3B and merges inside the header 3B. The refrigerant having merged inside the header 3B is refluxed to the external device (not illustrated) through a pipe (not illustrated) connected to the header 3B.

Each of the corrugated fins 2 is placed between one of the flat heat-transfer tubes 1 and another. The corrugated fins 2 are disposed to expand the area of heat transfer between the refrigerant and the outside air. Each of the corrugated fins 2 is formed in a pleated wave shape by a tabular-shaped fin material being subjected to corrugating and bent into a zigzag pattern with repeated mountain folds and valley folds. Note here that bent portions in undulations formed in a wave shape serve as apices of the wave shape. In Embodiment 1, the apices of each of the corrugated fins 2 are arranged in a height direction. Parts (a) to (e) of FIG. 1 will be described later.

Figure 2:
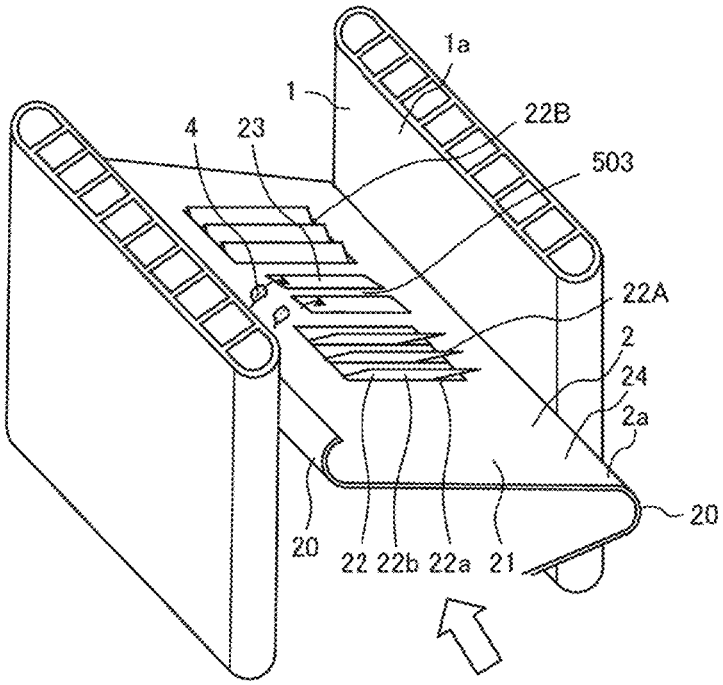
FIG. 2 is a schematic perspective view of part of the heat exchanger according to Embodiment 1.
Figure 3:
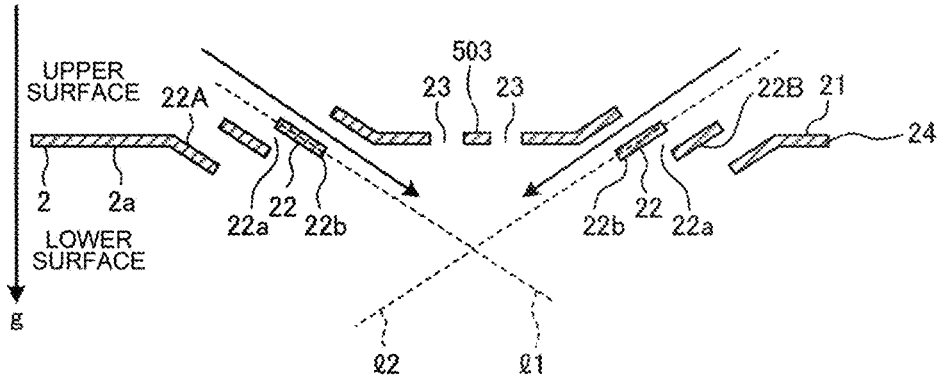
FIG. 3 is a schematic cross-sectional view of a flat-plate portion of a corrugated fin according to Embodiment 1 as taken along a direction of flow of air.

FIG. 2 is a schematic perspective view of part of the heat exchanger according to Embodiment 1. The arrow outlined with a blank inside in FIG. 2 indicates the direction of flow of air. FIG. 3 is a schematic cross-sectional view of a flat-plate portion of a corrugated fin according to Embodiment 1 as taken along the direction of flow of air. The diagonal solid arrows in FIG. 3 indicate the flow of condensed water.

The corrugated fin 2 is joined to flat surfaces 1*a* of flat heat-transfer tubes 1 except for an upstream protruding portion 2*a* protruding further upstream in the direction of flow of air than the flat heat-transfer tubes 1. These junctions are brazed and joined by a brazing filler metal. The corrugated fin 2 is formed by a fin material such as an aluminum alloy. Moreover, the fin material by which the corrugated fin 2 is formed has a surface cladded with a brazing filler metal layer. The clad brazing filler metal layer is made mainly of, for example, a brazing filler metal containing aluminum-silicon aluminum. Note here that the thickness of the fin material by which the corrugated fin 2 is formed ranges, for example, from approximately 50 μm to 200 μm.

The corrugated fin 2 is formed such that fin sections 24, which are plate-shaped, are joined together one after another in a wave shape in the tube axial direction. The corrugated fin 2 is shaped such that the fin sections 24 are joined together one after another in the tube axial direction at alternately reversed inclinations when the corrugated fin 2 is seen from an angle parallel with the direction of flow of air. Each of the fin sections 24 includes a flat-plate portion 21, which is tabular-shaped, and apices 20 curved at both respective ends of the flat-plate portion 21 in the tube side-by-side placement direction. The corrugated fin 2 has its apices 20 joined to the flat heat-transfer tubes 1 by making surface contact with the flat surfaces 1*a* of the flat heat-transfer tubes 1.

Each of the fin sections 24 has a plurality of louvers 22 formed and arranged in the direction of flow of air. Each of the louvers 22 includes a louver slit 22*a* through which air passes and a plate portion 22*b* that guides air to the louver slit 22*a*. The plate portion 22*b* is inclined to the flat-plate portion 21. The louver slit 22*a* and the plate portion 22*b* are each formed in the shape of a rectangle extending in the tube side-by-side placement direction. The louver 22 is formed by the plate portion 22*b* being cut and raised from the flat-plate portion 21.

The plurality of louvers 22 are divided into a first louver group 22A formed further upstream in the direction of flow of air than the after-mentioned drain slits 23 formed in the fin section 24 and a second louver group 22B formed further downstream in the direction of flow of air than the drain slits 23. The drain slits 23 are openings through which water having accumulated on an upper surface of the fin section 24, particularly the almost horizontal flat-plate portion 21, falls onto a lower surface.

Note here that, in FIG. 3, I1 is an imaginary auxiliary line to the midpoint of the through-thickness direction of a plate portion 22*b* of the first louver group 22A and 12 is an imaginary auxiliary line to the midpoint of the through-thickness direction of a plate portion 22*b* of the second louver group 22B. As shown in FIG. 3, when the flat-plate portion 21 has its upper and lower surfaces defined with reference to a direction of gravitational force g, the plate portion 22*b* of the first louver group 22A and the plate portion 22*b* of the second louver group 22B are inclined in directions set so that the auxiliary line 11 and the auxiliary line 12 to the respective midpoints intersect each other below the lower surface. In other words, the plate portion 22*b* of the first louver group 22A and the plate portion 22*b* of the second louver group 22B are inclined to the flat-plate portion 21 and inclined in respective directions that are opposite to each other. Since the plate portions 22*b* of the louvers 22 are formed in such directions, condensed water having flowed along the plate portions 22*b* of the louvers 22 formed in a fin section 24 is guided toward the drain slits 23 in a next fin section 24 below. Therefore, the heat exchanger 10, which has this configuration, can bring about great improvement in drainage capacity.

Each of the fin sections 24 has drain slits 23 through which condensed water produced on the fin section 24 is drained. The drain slits 23 are through holes opened in the corrugated fin 2. Each of the drain slits 23 is formed in the shape of a rectangle that extends in the tube side-by-side placement direction, that is, a direction orthogonal to the direction of flow of air. The drain slits 23 are formed in a central portion of the fin section 24 in the direction of flow of air excluding the upstream protruding portion 2*a*. Although FIG. 1 shows an example of the formation of drain slits 23 in two rows in the direction of flow of air, the row counts of drain slits 23 may be one or may be larger than or equal to three. In the case of the formation of drain slits 23 in a plurality of rows, a region of the fin section 24 situated between each adjacent two of the rows is a heat-transfer region 503. In the case of the formation of drain slits 23 in a plurality of rows, the drain slits 23 of the plurality of rows are adjacent to each other in a central portion of the fin section 24 in the direction of flow of air excluding the upstream protruding portion 2*a*. The term "adjacent to each other" means that there is no louver 22 between the drain slits 23.

The heat-transfer region 503 between the drain slits 23 of the plurality of rows is typically as flat as the flat-plate portion 21. Further, regions as flat as the flat-plate portion 21 may be formed between one of the drain slits 23 of the plurality of rows situated furthest upstream in the direction of flow of air and the first louver group 22A and between one of the drain slits 23 of the plurality of rows situated furthest downstream in the direction of flow of air and the second louver group 22*b*. The row counts of drain slits 23 is synonymous with the number of drain slits 23, and in the following, drain slits 23 are counted using either of the expressions "row counts" and "number".

In a case in which the heat exchanger 10 is used as an evaporator, the temperatures of surfaces of the flat heat-transfer tubes 1 and the corrugated fins 2 are lower than the temperature of air passing through the heat exchanger 10. This causes moisture in the air to condense into condensed water 4 on the surfaces of the flat heat-transfer tubes 1 and the corrugated fins 2. Condensed water 4 produced on a surface of the fin section 24 of a corrugated fin 2 flows down onto a next fin section 24 below through the drain slits 23. At this time, in a region of the surface of the fin section 24 where there is a large amount of condensed water 4, the condensed water 4 easily flows on the surface of the fin section 24 and easily flows down through the drain slits 23. Meanwhile, in a region of the surface of the fin section 24 where there is a small amount of condensed water 4, the condensed water 4 hardly flows on the surface of the fin section 24 and easily builds up by being retained on the surface of the fin section 24. It is known that such building-up occurs, although the fin section 24 is inclined when the fin section 24 is seen from an angle parallel with the direction of flow of air. To address this problem, Embodiment 1 brings about improvement in drainage capacity by locating drain slits 23 in the following positions.

[Positions of Drain Slits 23]

Figure 4:
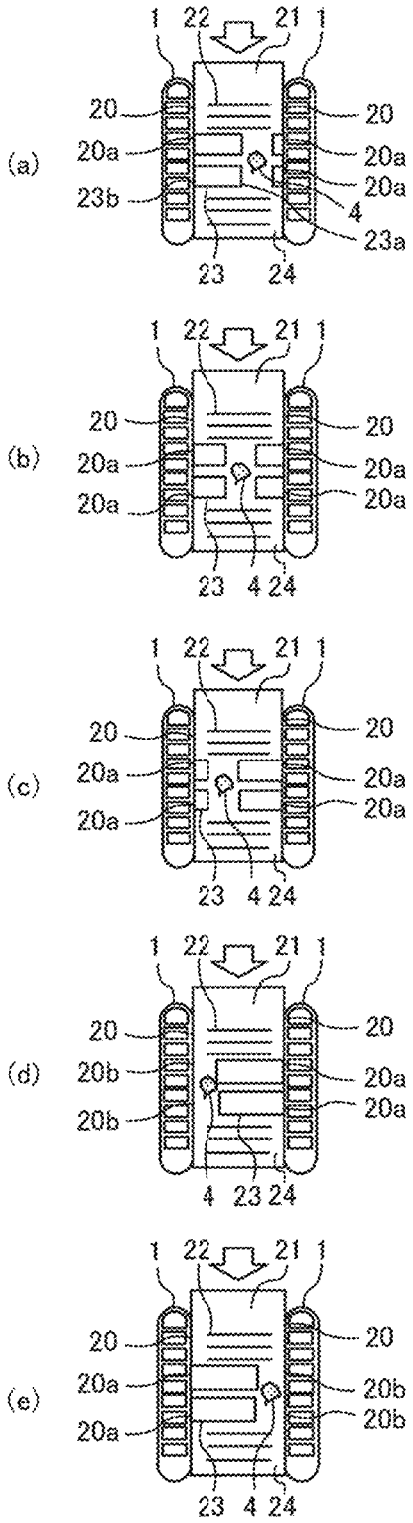
FIG. 4 is an explanatory diagram of the positions of drain slits in fin sections of a corrugated fin according to Embodiment 1.

FIG. 4 is an explanatory diagram of the positions of drain slits in fin sections of a corrugated fin according to Embodiment 1. Parts (a) to (e) of FIG. 4 correspond to fin sections 24 located in positions indicated by respective parts (a) to (e) of FIG. 1. That is, parts (a) to (e) of FIG. 4 show fin sections 24 adjacent to one another in the tube axial direction. Parts (a) to (c) of FIG. 4 each show a configuration in which there are a total of four drain slits formed by drain slits 23 being formed in two rows in the direction of flow of air with each row formed by two drain slits 23 in the tube side-by-side placement direction. Parts (d) and (e) of FIG. 4 each show a configuration in which there are a total of two drain slits formed by drain slits 23 being formed in two rows each formed by one drain slit 23.

As shown in FIG. 4, the drain slits 23 are placed so that drain slits 23 in fin sections 24 adjacent to each other in the tube axial direction are displaced from each other in the tube side-by-side placement direction. Such placement of the drain slits 23 causes drained condensed water to flow in the following way through the corrugated fin 2. The flow of condensed water is described here with reference to two fin sections 24 adjacent one above the other.

Condensed water produced on the surface of the upper fin section 24 flows down onto the lower fin section 24 through the drain slits 23 in the upper fin section 24. Note here that, as mentioned above, drain slits 23 in fin sections 24 adjacent to each other in the tube axial direction are displaced from each other in the tube side-by-side placement direction. For this reason, part of a region directly below the drain slits 23 in the upper fin section 24 is a portion of the lower fin section 24 in which no drain slits 23 are formed and a portion in which condensed water is produced and retained. Therefore, condensed water 4 having fallen onto the lower fin section 24 through the drain slits 23 in the upper fin section 24 merges with condensed water 4 having become stagnant by being retained on the surface of the lower fin section 24. The condensed water 4, which has increased in amount by merging, comes to easily flow down, and is drained through the drain slits 23 in the lower fin section 24. The aforementioned flow of condensed water is repeated in sequence in the up-down direction between two fin sections 24 adjacent to each other in the tube axial direction, and less condensed water 4 is thus retained on the surface of each fin section 24. This leads to efficient drainage.

Incidentally, in each of parts (a) to (c) of FIG. 4, the drain slits 23 are formed to, when the drain slits 23 are seen from an angle parallel with the tube axial direction, overlap the apices 20 at both respective ends of the flat-plate portion 21 in the tube side-by-side placement direction. In each of parts (d) and (e) of FIG. 4, 24 of the drain slits are formed to, when 24 of the drain slits are seen from an angle parallel with the tube axial direction, overlap the apex 20 at one end of the flat-plate portion 21 in the tube side-by-side placement direction. In the following, a portion of a fin section 24 in which a drain slit 23 overlaps an apex 20 is referred to as "drain apex 20*a*", and a portion of a fin section 24 in which a drain slit 23 does not overlap an apex 20 is referred to as "non-drain apex 20*b*" for explanatory convenience.

In each of parts (a) to (c) of FIG. 4, the drain slits 23 form two rows each formed by two drain slits 23 overlapping the apices 20 at both respective ends of the fin section 24 in the tube side-by-side placement direction. For this reason, in each of parts (a) to (c) of FIG. 4, the fin section 24 has four drain apices 20*a*.

In part (d) of FIG. 4, the drain slits 23 form two rows each formed by one drain slit 23 overlapping the apex 20 at one end (right in FIG. 4) of the fin section 24 in the tube side-by-side placement direction. For this reason, the fin section 24 of part (d) of FIG. 4 has two drain apices 20*a*. In part (d) of FIG. 4, each row is not formed by any one drain slit 23 overlapping the apex 20 at the other end (left in FIG. 4) of the fin section 24 in the tube side-by-side placement direction. For this reason, the fin section 24 of part (d) of FIG. 4 has two non-drain apices 20*b*.

In part (e) of FIG. 4, the drain slits 23 form two rows each formed by one drain slit 23 overlapping the apex 20 at one end (left in FIG. 4) of the fin section 24 in the tube side-by-side placement direction. For this reason, the fin section 24 of part (e) of FIG. 4 has two drain apices 20*a*. In part (e) of FIG. 4, each row is not formed by any one drain slit 23 overlapping the apex 20 at the other end (right in FIG. 4) of the fin section 24 in the tube side-by-side placement direction. For this reason, the fin section 24 of part (d) of FIG. 4 has two non-drain apices 20*b*.

Figure 6:
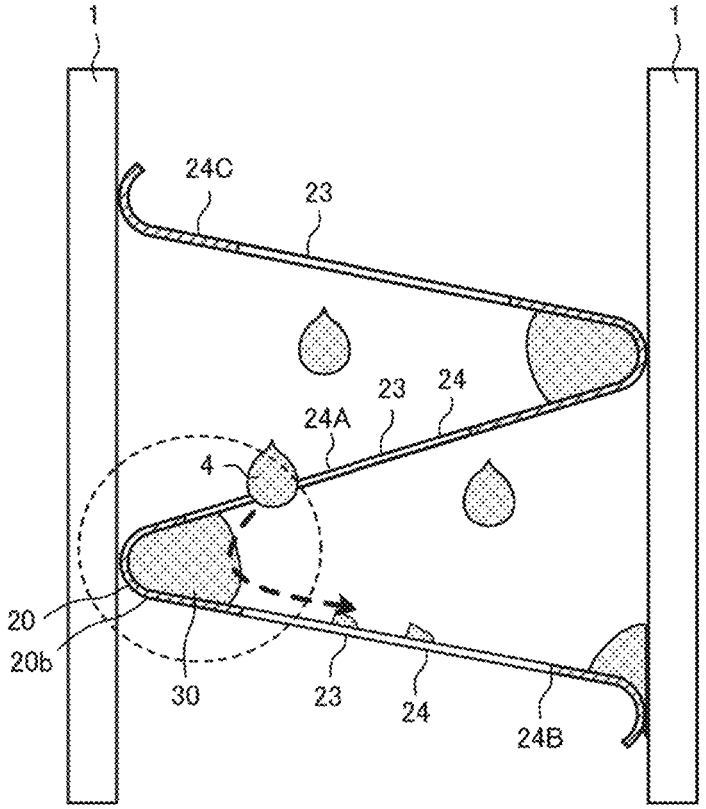
FIG. 6 is an explanatory diagram of the flow of condensed water in the configuration of FIG. 5.

Since each of the apices 20 is a portion formed by bending a tabular-shaped fin material into the shape of letter V, that apex 20 has a narrow inner space (see FIG. 6, which will be described later). Therefore, condensed water 4 produced on an inner surface of an apex 20 easily builds up by being retained in the inner space of the apex 20 by the surface tension of the condensed water 4. For this reason, the drain apices 20*a* of the apices 20 make it possible to prevent condensed water from building up in the inner spaces of the apices 20 and bring about improvement in drainage capacity. It should be noted that although a larger number of drain apices 20*a* further bring about an effect of improvement in drainage capacity, increasing the number of drain apices 20*a* invites a deterioration in heat-transfer capacity, as the apices 20 are portions that are joined to the flat heat-transfer tubes 1 for heat transfer. Therefore, it is only necessary to determine the proportion of the number of drain apices 20*a* to the number of non-drain apices 20*b* in consideration of drainage capacity and heat-transfer capacity. Further, increasing the number of drain apices 20*a* invites a deterioration of strength by reducing the junctions between the fin sections 24 and the flat heat-transfer tubes 1. For this reason, a configuration is desirable in which there is a well-balanced allocation of drain apices 20*a* and non-drain apices 20*b* throughout the corrugated fin 2.

Such a configuration makes it possible to expect improvement in drainage capacity while reducing deterioration of heat-transfer performance without decreasing the area of contact between the flat heat-transfer tubes 1 and the corrugated fin 2.

Figure 5:
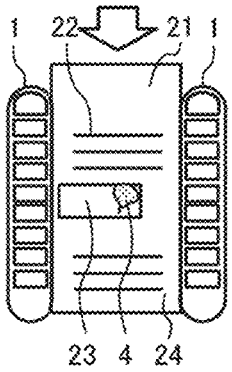
FIG. 5 is a diagram showing a modification of the heat exchanger according to Embodiment 1.
Figure 5:
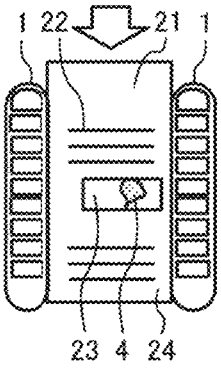

Although FIG. 4 has shown examples in each of which the drain slits 23 are formed in positions at which, when the drain slits 23 are seen from an angle parallel with the tube axial direction, the drain slits 23 overlap the apices 20 at both respective ends of the flat-plate portion 21 in the tube side-by-side placement direction, the drain slits 23 may be formed in positions indicated by FIG. 5.

FIG. 5 is a diagram showing a modification of the heat exchanger according to Embodiment 1. Part (a) of FIG. 5 shows an upper one of fin sections 24 adjacent to each other in the tube axial direction, and part (b) of FIG. 5 shows a lower one of the fin sections 24 adjacent to each other in the tube axial direction. FIG. 6 is an explanatory diagram of the flow of condensed water in the configuration of FIG. 5.

In FIG. 5, the drain slits 23 are formed in positions, when the drain slits 23 are seen from an angle parallel with the tube axial direction, at which the drain slits 23 do not overlap the apices 20 at both respective ends of the flat-plate portion 21 in the tube side-by-side placement direction.

The flow of condensed water in the modification of FIG. 5 is described with reference to FIG. 6. Of the two fin sections 24 that forms the apex 20 surrounded by a dotted circle in FIG. 6, the upper fin section 24A corresponds to the fin section 24 of part (a) of FIG. 5, and the lower fin section 24B corresponds to the fin section 24 of part (b) of FIG. 5.

Since the fin section 24A and the fin section 24B are placed such that the drain slits 23 do not overlap the apices 20 when the drain slits 23 are seen from an angle parallel with the tube axial direction, the apex 20 between the fin section 24A and the fin section 24B is a non-drain apex 20*b*. For this reason, the surface tension of the condensed water 4 causes condensed water to easily build up in the inner space of the non-drain apex 20*b*. In the following, a portion in which condensed water 4 has built up is referred to as "apex built-up portion 30". The following describes drainage of the condensed water 4 having built up in the apex built-up portion 30.

Condensed water produced and accumulated on the surface of a fin section 24C above the fin section 24A flows down toward the fin section 24A through the drain slit 23 in the fin section 24C. Note here that the drain slit 23 formed in the fin section 24C and the drain slit 23 formed in the fin section 24A are displaced from each other in the tube side-by-side placement direction (right-left direction in FIG. 6). For this reason, condensed water 4 having flowed down through an end (here, a left end in FIG. 6) of the drain slit 23 in the fin section 24C in the tube side-by-side placement direction passes through the drain slit 23 in the fin section 24A and merges with the condensed water 4 having built up in the apex built-up portion 30. This merging causes the condensed water 4 in the apex built-up portion 30 to flow out from the apex built-up portion 30 as a result of the breakage of the surface tension and flow on the surface of the fin section 24B as indicated by a dotted arrow in FIG. 6. This manner can bring about improvement in drainage capacity of fin sections 24 whose drain slits 23 are formed in positions at which the drain slits 23 do not overlap apices 20 when the drain slits 23 are seen from an angle parallel with the tube axial direction.

[Relationship Between Row Counts of Drain Slits 23 and Drainage Capacity]

Figure 7:
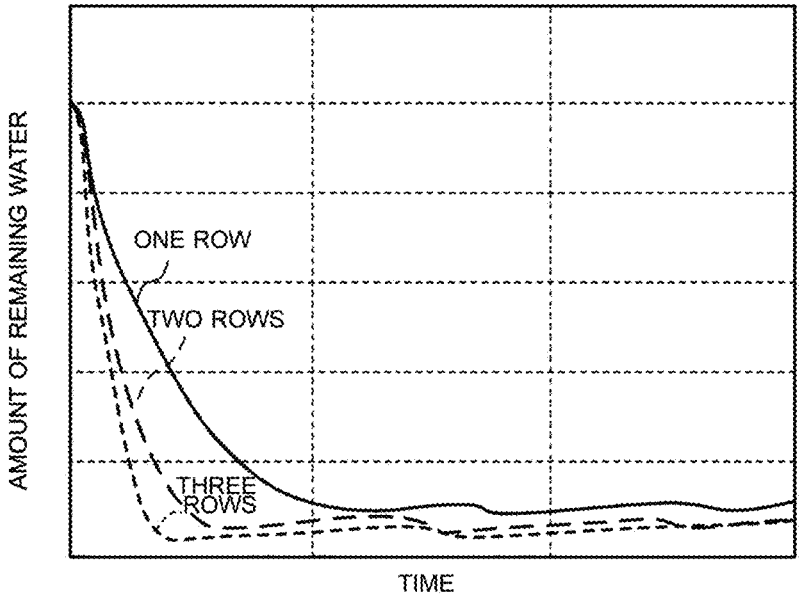
FIG. 7 is a diagram showing an example of a result of analysis of drainage characteristics according to the row counts of drain slits.

FIG. 7 is a diagram showing an example of a result of analysis of drainage characteristics according to the row counts of drain slits. In FIG. 7, the vertical axis represents the amount of water remaining in a heat exchanger, and the horizontal axis represents time. A higher speed of reduction in the amount of remaining water indicates higher drainage capacity. Drainage capacity is the amount of water that is drained per unit time. In general, measurements of drainage capacity are made in the following manner. An experimental model of a heat exchanger having fin sections each having a drain slit 23 forming one row, an experimental model of a heat exchanger having fin sections each including drain slits 23 each having the same opening area and forming two rows, and an experimental model of a heat exchanger having fin sections each including drain slits 23 each having the same opening area and forming three rows are fabricated. Then, each of the heat exchangers is put into water in a tank and taken out again, and the amount of water remaining in each heat exchanger is measured with passage of time. FIG. 7 is a tabulation of examples of computational results yielded by simulating the aforementioned test evaluations using a two-phase gas-liquid three-dimensional analysis developed by the inventors.

It is found from FIG. 7 that a larger row counts of drain slits 23 further brings about higher drainage capacity. A reason for this is that the formation of drain slits 23 in a plurality of rows makes it possible to increase the total opening area of drain slits 23 in one fin section 24.

Further, in one example of a result of analysis by the inventors, a comparison of drainage capacity between a case in which two drain slits 23 were provided and a case in which one drain slit 23 having the total opening area of the two drain slits 23 was provided showed that higher drainage capacity can be attained in the case in which the two drain slits 23 were provided. According to an analysis by the inventors, it was found that this improvement in drainage capacity is brought about by the following mechanism. Even with an increase in opening area of a drain slit 23, an area in the vicinity of the center of the drain slit 23 does not contribute to drainage, and in actuality, water flows down along an inner peripheral portion of the drain slit 23. Therefore, an increase in opening area of a drain slit 23 is slightly effective in bringing about improvement in drainage capacity and, on the other hand, causes a great deterioration in performance due to a reduction in heat-transfer area. Configuring drain slits 23 in a plurality of rows so that the drain slits 23 have longer inner peripheral lengths is thus effective in bringing about improvement in drainage capacity. This allows the heat exchanger 10 to improve drainage capacity while reducing deterioration of heat-transfer performance.

Further, the separation of drain slits 23 to which two louver groups opposite in inclination to each other are situated close is considered to bring about an effect of enhancing drainage with a small drain opening area. According to an experiment and an analysis by the inventors, it was found that compatibility between improvement in drainage capacity and heat-transfer performance cannot be necessarily achieved by simply increasing the opening area. A reason for this is that an increase in opening area causes a reduction in heat-transfer area and results in a deterioration in heat exchanger performance. According to an analysis by the inventors, it was found out that the wetted perimeter length of a drain slit is important for drainage.

According to this result of analysis, an increase in wetted perimeter length can be better achieved by continuously providing small drain slits than by placing a drain slit having a large opening, and improvement in drainage capacity can be brought about. On the basis of this thought, the wetted perimeter length of a drain slit 23 per louver group can be increased, especially as two louver groups opposite in inclination to each other come close to respective drain slits 23. This makes it possible to improve drainage capacity while minimizing as possible the opening area of a drain slit 23.

The foregoing allows the heat exchanger 10 to, by having drain slits 23 in a plurality of rows between the first louver group 22A and the second louver group 22B, improve drainage capacity while maintaining heat-transfer performance.

[Relationship Between Ratio of Inter-Louver Air Passage Cross-Sectional Area AL to Drain Slit Opening Area as and Drainage Velocity]

The inventors found out through an experiment and an analysis that there is a relationship between the ratio of an inter-louver air passage cross-sectional area AL to a drain slit opening area As and drainage velocity. This point is explained below.

Figure 8:
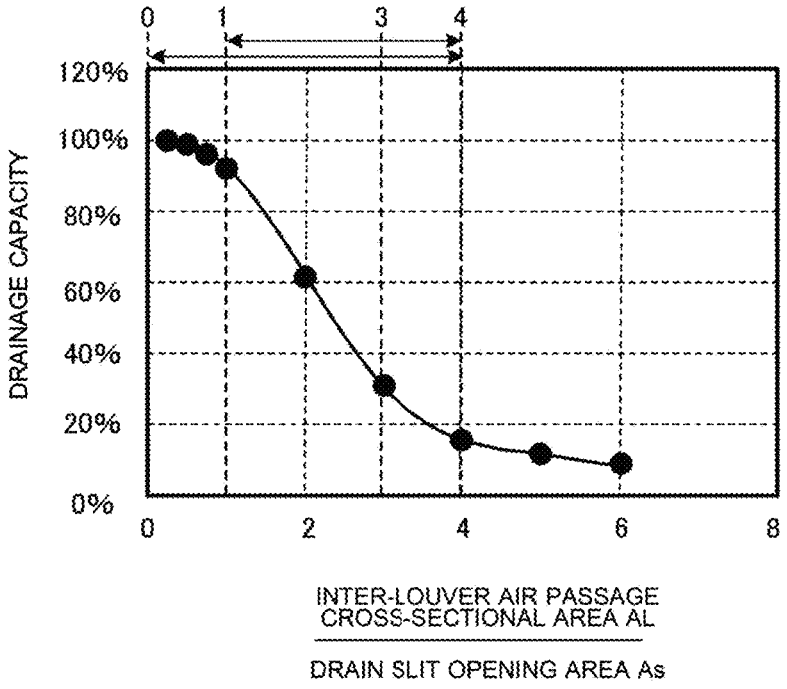
FIG. 8 is a diagram showing an example of a graph representing a relationship between the ratio of an inter-louver air passage cross-sectional area AL to a drain slit opening area As and drainage capacity.
Figure 9:
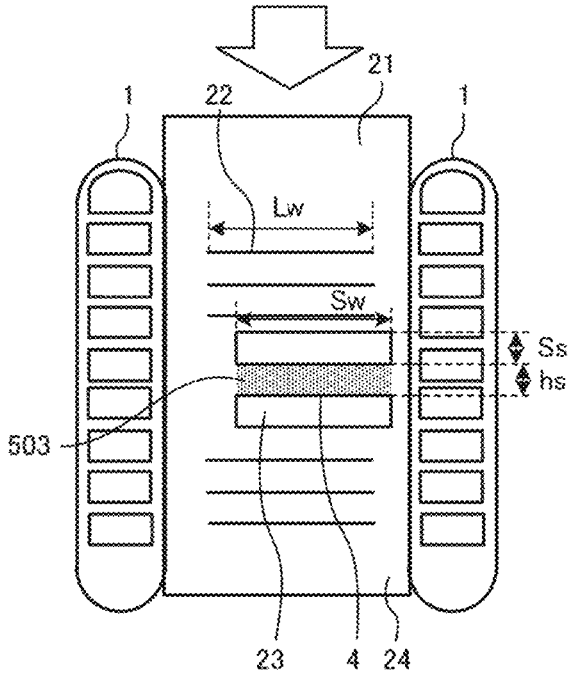
FIG. 9 is a diagram showing the dimensions of each component for use in a description of the relationship of FIG. 8.
Figure 10:
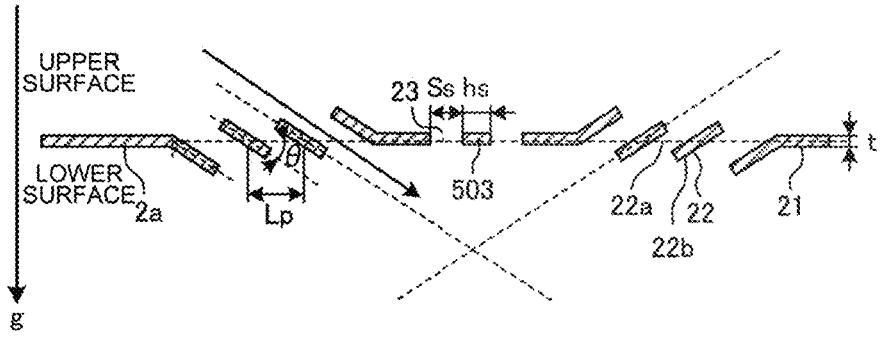
FIG. 10 is an explanatory diagram of the dimensions of each component for use in the description of the relationship of FIG. 8.

FIG. 8 is a diagram showing an example of a graph representing a relationship between the ratio of an inter-louver air passage cross-sectional area AL to a drain slit opening area As and drainage capacity. Drainage capacity is the amount of water that is drained per unit time, and higher drainage capacity means that a larger amount of water is drained per unit time. FIG. 8 shows as an example a graph of a result of analysis showing a relationship in a case in which drainage capacity is defined as 100% in a case in which the ratio of the inter-louver air passage cross-sectional area AL to the drain slit opening area As is 0.25. As in the case of FIG. 7, this result of analysis is a tabulation of examples of computational results yielded by putting heat exchangers into water in a tank, taking them out again, and calculating, at a given point of time, the amount of water remaining in each heat exchanger. FIG. 9 is a diagram showing the dimensions of each component for use in a description of the relationship of FIG. 8, and is a schematic plan view of part of a heat exchanger. FIG. 10 is an explanatory diagram of the dimensions of each component for use in the description of the relationship of FIG. 8, and is a schematic cross-sectional view of a fin section as taken along the direction of flow of air.

Drainage velocity is greatly affected by the ratio of the inter-louver air passage cross-sectional area AL to the drain slit opening area As. The inter-louver air passage cross-sectional area AL is defined as $NL \times Ls \times Lw = NL \times ((Lp \times \sin\theta) - t) \times Lw$. The drain slit opening area As is defined as $Ns \times Sw \times Ss$.

In these formulas,

NL [–] is the number of louvers 22,

θ [rad] is the angle of a plate portion 22*b* inclined to a flat-plate portion 21 (hereinafter referred to as "louver angle"), Lp [mm] is the pitch between adjacent louvers 22, Lw [mm] is the width of a louver 22 in the tube side-by-side placement direction (hereinafter referred to as "louver width"), t [mm] is the thickness of a corrugated fin, Ns [–] is the row counts of drain slits 23, Sw [mm] is the width of a drain slit 23 in the tube side-by-side placement direction (hereinafter referred to as "drain slit width"), and Ss [mm] is the length of a drain slit 23 in the direction of flow of air (hereinafter referred to as "drain slit length").

With AL/As being greater than or equal to 4, a decrease in value of AL/As leads to a rise in drainage velocity and an increase in rate of the rise. Therefore, with the inter-louver air passage cross-sectional area AL being constant, an increase in the drain slit opening area As leads to a greater effect of improvement in drainage velocity. For this reason, increasing the drain slit opening area As by providing drain slits 23 in a plurality of rows makes it possible to increase drainage velocity.

Note, however, that with AL/As lowered to less than 1, the rate of rise in drainage velocity to an increase in the drain slit opening area As decreases, although drainage velocity can be increased. A reason for this is that with AL/As being less than 1, the drain slit opening area As exceeds the inter-louver air passage cross-sectional area AL, so that the amount of water that is drained through the drain slits 23 is large and limits are put on the characteristics of drainage through the louvers 22. Further, with AL/As being less than 1, heat-transfer performance decreases as the drain slit opening area As increases, albeit with high drainage velocity and high drainage capacity. For this reason, in view of a balance between drainage capacity and heat-transfer performance, it is preferable that $AL/As \geq 1$.

Meanwhile, with AL/As being greater than 4, drainage velocity does not increase greatly although the drain slit opening area As increases. For this reason, making AL/As greater than 4 is not effective in bringing about improvement in drainage capacity. A possible reason why drainage velocity does not increase greatly although the drain slit opening area As increases is that condensed water guided by the louvers 22 cannot be sufficiently handled by the drain slits 23 because the inter-louver air passage cross-sectional area AL is too great for the drain slit opening area As.

The foregoing makes it possible, with AL/As being greater than or equal to 1 and less than or equal to 4, to effectively improve drainage capacity and ensure heat-transfer performance by providing drain slits 23. The graph of the relationship of FIG. 8 also applies to a corrugated fin 2, such as that described in Embodiment 4 below, in which the upstream protruding portion 2*a* of a fin section 24 is thickened. Further, the graph of the relationship of FIG. 8 also applies to a corrugated fin 2 provided with louvers 22 and drain slits 23 regardless of the number or placement of drain slits 23. Therefore, a heat exchanger having corrugated fins 2 provided with louvers 22 and drain slits 23 and satisfying $1 \leq AL/As \leq 4$ can improve drainage capacity while maintaining heat-transfer capacity. In FIGS. 9 and 10, hs denotes the length of the heat-transfer region 503 (indicated by half-tone dot meshing in FIG. 9) in the direction of flow of air. This length hs is described below.

[Relationship Between Length Hs of Heat-Transfer Region 503 in Direction of Flow of Air and Length Ss of One Drain Slit in Direction of Flow of Air]

In a case in which drain slits 23 are formed in a plurality of rows, a heat-transfer region 503 (see FIGS. 9 and 10) is formed between drain slits. The heat-transfer region 503 is low in heat-transfer efficiency as a heat transfer surface, as it is a region surrounded by the drain slits 23. However, the heat-transfer region 503 generates a vortex and exerts a heat-transfer enhancement effect downstream of the heat-transfer region 503 through turbulence enhancement. Because of the characteristics of turbulence enhancement, improvement in heat-transfer performance can be brought about when the length hs of the heat-transfer region 503 in the direction of flow of air is shorter than the length Ss of a drain slit 23 in the direction of flow of air. Further, according to an analysis by the inventors, improvement in drainage capacity can be brought about as will be described below when the length hs of the heat-transfer region 503 in the direction of flow of air is shorter than the length Ss of a drain slit 23 in the direction of flow of air.

The distance between drain slits 23 adjacent to each other in the direction of flow of air becomes shortened when the length hs of the heat-transfer region 503 in the direction of flow of air is shorter than the length Ss of a drain slit 23 in the direction of flow of air. When the distance between drain slits 23 adjacent to each other in the direction of flow of air becomes shortened, drops of water falling from the drain slits 23 merge into a single great drop of water and fall. That is, the two narrow drain slits 23 serve as one wide slit. Therefore, the effect of improvement in drainage capacity is considered to be greater when the length hs of the heat-transfer region 503 in the direction of flow of air is shorter than the length Ss of a drain slit 23 in the direction of flow of air.

The effect of improvement in drainage capacity is considered to be brought about when the length hs of the heat-transfer region 503 in the direction of flow of air is only slightly longer than the length Ss of a drain slit 23 in the direction of flow of air A reason for this is that the louvers 22 situated close to the respective drain slits 23 are inclined in opposite directions and the respective drain slits 23 are separate from each other. However, when the length hs of the heat-transfer region 503 in the direction of flow of air becomes far longer than the length Sa of a drain slit 23, condensed water tends to remain on the heat-transfer region 503 and drops of waterfall separately from each of the drain slits 23, although there is a benefit from the standpoint of strength increase. For this reason, it is considered that the effect of improvement in drainage capacity decreases when the length hs of the heat-transfer region 503 in the direction of flow of air becomes longer than the length Ss of a drain slit 23 in the direction of flow of air. In sum, the formation of a plurality of drain slits 23 in the direction of flow of air is important to bringing about the effect of improvement in drainage capacity, and it is even more desirable to shorten the distance between drain slits 23 to minimize as possible a reduction in heat-transfer area.

For reasons similar to those noted above, it is also preferable that the distance between the louver group 22A and a drain slit 23 and the distance between the louver group 22B and a drain slit 23 be short too. If the heat-transfer region 503 and the drain slits 23 have flat regions that are long in the direction of flow of air, condensed water tends to remain. It is thus more desirable that the distances in the direction of flow of air between the drain slit 23 situated furthest upstream in the direction of flow of air and the first louver group 22A and between the drain slit 23 situated furthest downstream in the direction of flow of air and the second louver group 22*b* be each for example made shorter than or equal to the length of one louver 22 in the direction of flow of air.

Further, the heat-transfer region 503 and the drain slits 23 are alternately present in the direction of flow of air. When this configuration is looked at differently, this configuration is equivalent to a configuration in which a narrow bridge extending in the tube side-by-side placement direction (right-left direction in FIG. 9) is built in the middle of one large hole in the direction of flow of air and the large hole is divided into a plurality of holes. Moreover, this bridge is equivalent to the heat-transfer region 503. Setting up a configuration in which the heat-transfer region 503 equivalent to a narrow bridge is provided as a mechanism for improvement in drainage capacity is considered to make it easy for water to be guided along the heat-transfer region 503 toward the center of the space between the two drain slits 23 in the direction of flow of air.

Water having fallen from the vicinity of the center of the space between drain slits 23 in one fin section 24 falls onto the vicinity of the center of the space between drain slits 23 in a next fin section 24 below and merges with water guided from another fin section 24 and falls onto a further next fin section 24 below. As a result of that, even when the plurality of fin sections 24 are separated one above the other, smooth drainage through the drain slits 23 in the up-down direction is achieved. That is, the heat-transfer region 503 located between the drain slits 23 or, in other words, a portion of the flat-plate portion 21 located between the drain slits 23 also serves as a water conduit. In the following, a portion of the flat-plate portion 21 located between the drain slits 23 is sometimes referred to as "water conduit 21A". The water conduit 21A has the shape of a long plate whose long side extends in the tube side-by-side placement direction and whose short side extends in the direction of flow of air.

According to the foregoing, a heat exchanger in which the length hs of the heat-transfer region 503 in the direction of flow of air is shorter than the length Ss of a drain slit 23 in the direction of flow of air can improve drainage capacity while maintaining heat-transfer capacity. In a case in which three or more drain slits 23 are provided, a plurality of drain slits 23 need only be provided at intervals that are each shorter than the length Ss of a drain slit 23 in the direction of flow of air.

Incidentally, the heat-transfer region 503 acts as a holder to inhibit warpage deformation of a fin material from occurring during punching of drain slits 23 through the fin material. This point is explained with reference to a corrugated fin of a comparative example including no heat-transfer region 503.

Figure 11:
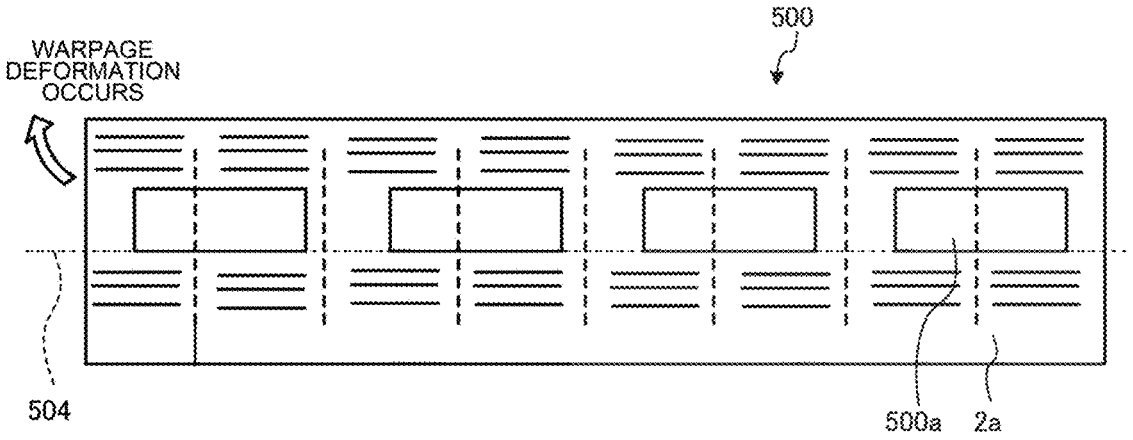
FIG. 11 is an explanatory diagram of warpage deformation during punching in a corrugated fin of a comparative example.

FIG. 11 is an explanatory diagram of warpage deformation during punching in the corrugated fin of the comparative example. FIG. 11 shows a fin material yet to be subjected to corrugating. Dotted lines extending in a longitudinal direction in FIG. 11 indicate border lines between fin sections.

The fin material 500 of the comparative example does not include a heat-transfer region 503 but has one large opening 500*a* that is to become a drain slit. The opening 500*a* is disposed in a central part of the fin material 500 in the direction of flow of air excluding the upstream protruding portion 2*a*. For this reason, the opening 500*a* deviates to one side of the fin material 500 from a center line 504 in the direction of flow of air. When the opening 500*a* deviates to one side in this manner, moment is produced on the side (upper side in FIG. 11) to which the opening 500*a* deviates, and warpage of the fin material 500 occurs, resulting in deformation.

On the other hand, a corrugated fin 2 of Embodiment 1 is equivalent to a configuration in which one large opening 500*a* in the comparative example is divided into a plurality of small openings. In this configuration, a heat-transfer region 503 is formed between small openings. In other words, a fin material portion that is not a hole is formed between small openings. For this reason, this fin material portion acts as a holder to inhibit warpage deformation, and the corrugated fin 2 of Embodiment 1 can improve warpage deformation.

[Angles of Louvers 22]

According to an experiment and an analysis by the inventors, it was found that louver angles greatly affect drainage capacity. This point is explained below.

Figure 12:
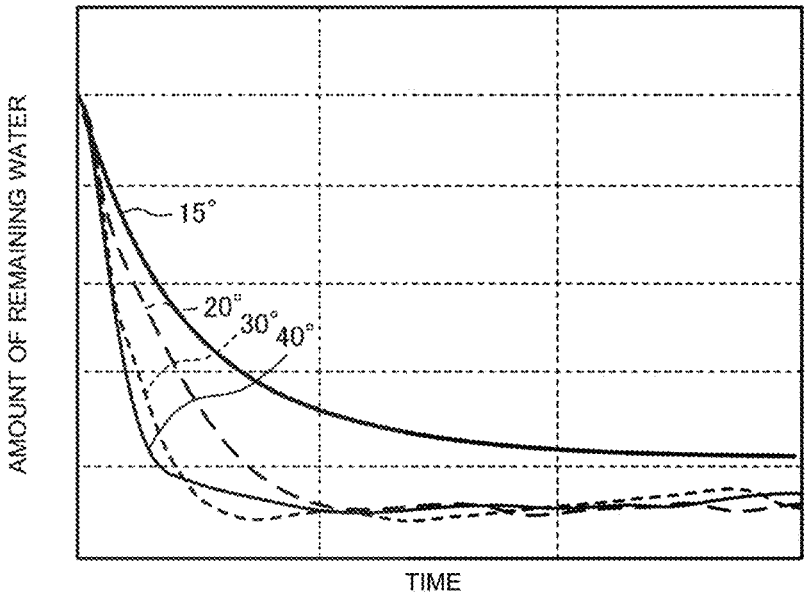
FIG. 12 is a diagram showing an example of a result of analysis of drainage characteristics according to louver angles.

FIG. 12 is a diagram showing an example of a result of analysis of drainage characteristics according to louver angles. In FIG. 12, the vertical axis represents the amount of water remaining in a heat exchanger, and the horizontal axis represents time. A higher speed of reduction in the amount of remaining water indicates higher drainage capacity. This analysis is conducted in the following manner. A computation model of a heat exchanger having fin sections provided with louvers having a louver angle of 15 degrees, a computation model of a heat exchanger having fin sections provided with louvers having a louver angle of 20 degrees, a computation model of a heat exchanger having fin sections provided with louvers having a louver angle of 30 degrees, and a computation model of a heat exchanger having fin sections provided with louvers having a louver angle of 40 degrees are prepared. Then, the heat exchangers are put into water in a tank and taken out again, and the amount of water remaining in each heat exchanger is measured with passage of time using a two-phase gas-liquid three-dimensional analysis developed by the inventors. The result of analysis of FIG. 12 is a tabulation of these results of measurement.

It is found from FIG. 12 that an increase in louver angle leads to an increase in speed of reduction in the amount of remaining water and higher drainage capacity. A possible reason for this is that an increase in louver angle leads to a greater gravitational drainage effect to facilitate the breakage of surface tension of condensed water on the surfaces of the louvers 22. Moreover, while an increase in louver angle leads to an increase in speed of reduction in the amount of remaining water, the degree of the rise relatively decreases once the louver angle exceeds 30 degrees. Further, an increase in louver angle leads to an increase in air passage resistance on the plate portions 22*b* of the louvers 22, making it hard for air to flow. Therefore, in view of compatibility between improvement in drainage capacity and ease of flow of air, it is preferable that the louver angle range from 15 degrees to 30 degrees.

[Processing of Drain Slits 23 in Corrugated Fin 2]

As mentioned above, it is desirable that a corrugated fin 2 be formed such that there is a well-balanced mixture of drain apices 20*a* and non-drain apices 20*b*. In achieving such a configuration, a fin material yet to be subjected to corrugating needs only be processed so that drain slits 23 are placed in any of the following patterns. Four patterns of placement of drain slits 23 in a fin material are described below with reference to FIGS. 13 to 16 below. FIGS. 13 to 16 below show tabular-shaped fin materials yet to be subjected to corrugating. Further, dotted lines extending in a longitudinal direction in FIGS. 13 to 16 indicate border lines I3 between fin sections.

[Shapes of Drain Slits 23]

A main mechanism for drainage of condensed water in a corrugated fin 2 is such that the louvers 22 cause the condensed water to flow down in the direction of flow of air and the water is collected by the drain slits 23 for drainage. For this reason, even if the drain slits 23 are identical in opening area and wetted perimeter length to each other, improvement in drainage capacity can be brought about while a reduction in heat-transfer area is minimized as possible, provided the drain slits 23 have shapes whose long sides extend in the tube side-by-side placement direction and whose short sides extend in the direction of flow of air. In consideration of processability or other properties, it is thus preferable, for example, that the drain slits 23 have rectangular shapes as illustrated in FIGS. 4, 5, 9, and 18 or other drawings.

(Pattern of Placement 1)

Figure 13:
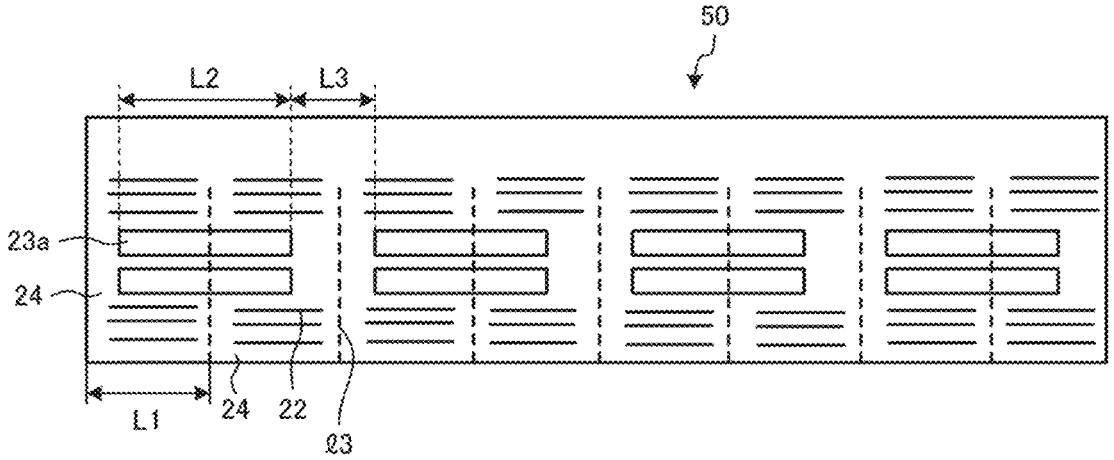
FIG. 13 is an explanatory diagram of a pattern of placement 1 of openings for drain slits in a corrugated fin according to Embodiment 1.

FIG. 13 is an explanatory diagram of a pattern of placement 1 of openings for drain slits in a corrugated fin according to Embodiment 1. It is a diagram showing a fin material of.

In the pattern of placement 1, the width L2 of an opening 23*a* that is to become a drain slit 23 is longer than the length L1 of a fin section 24 in the tube side-by-side placement direction. The openings 23*a* of adjacent fin sections 24 are equally spaced from one another. That is, the length L3 of each space is the same in every place in a direction parallel with the length of the fin material 50. The openings 23*a* are placed across the border lines I3. A fin material 50 yet to be subjected to corrugating is processed so that openings 23*a* that are to become drain slits 23 are sized and placed in the foregoing pattern, and a corrugated fin 2 subjected to corrugating thus can be formed such that there is a well-balanced mixture of drain apices 20*a* and non-drain apices 20*b*.

(Pattern of Placement 2)

Figure 14:
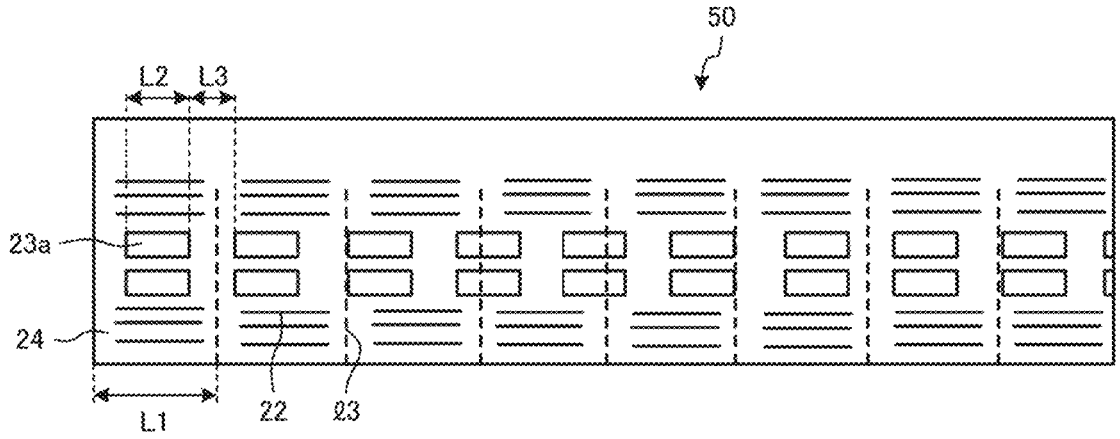
FIG. 14 is an explanatory diagram of a pattern of placement 2 of openings for drain slits in a corrugated fin according to Embodiment 1.

FIG. 14 is an explanatory diagram of a pattern of placement 2 of openings for drain slits in a corrugated fin according to Embodiment 1.

In the pattern of placement 2, the width L2 of an opening 23*a* that is to become a drain slit 23 is shorter than the length L1 of a fin section 24 in the tube side-by-side placement direction. The openings 23*a* of adjacent fin sections 24 are equally spaced from one another. That is, the length L3 of each space is the same in every place in a direction parallel with the length of the fin material 50. It should be noted that the length L3 is a value other than a value obtained by subtracting L2 from L1. A reason for this is that if L3 is a value obtained by subtracting L2 from L1, there is a possibility that all apices 20 are either drain apices 20*a* or non-drain apices 20*b* instead of being a mixture of drain apices 20*a* and non-drain apices 20*b*. A fin material 50 yet to be subjected to corrugating is processed so that openings 23*a* that are to become drain slits 23 are sized and placed in the foregoing pattern, and a corrugated fin 2 subjected to corrugating thus can be formed such that there is a well-balanced mixture of drain apices 20*a* and non-drain apices 20*b*.

(Pattern of Placement 3)

Figure 15:
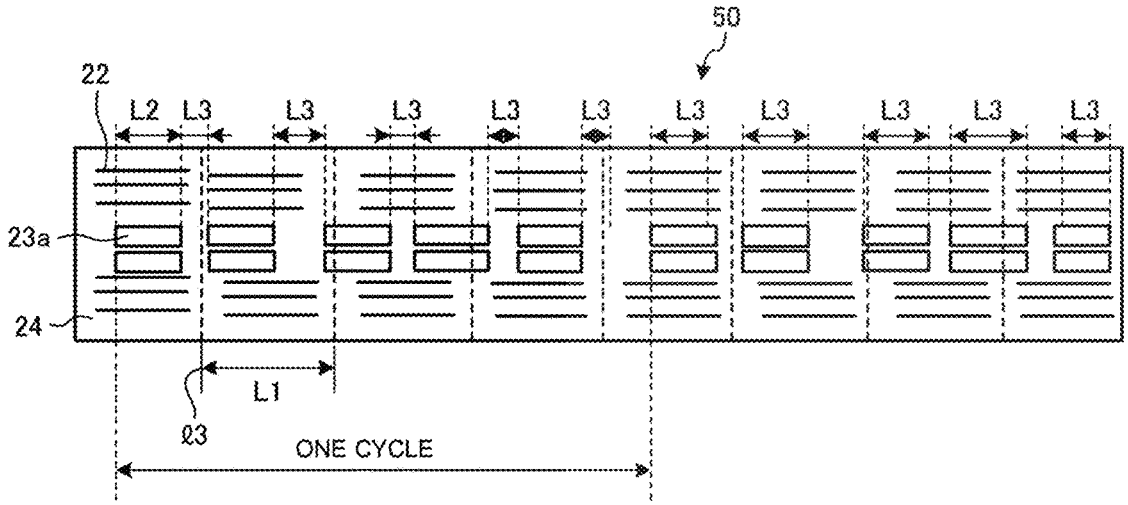
FIG. 15 is an explanatory diagram of a pattern of placement 3 of openings for drain slits in a corrugated fin according to Embodiment 1.

FIG. 15 is an explanatory diagram of a pattern of placement 3 of openings for drain slits in a corrugated fin according to Embodiment 1.

In the pattern of placement 3, the width L2 of an opening 23*a* that is to become a drain slit 23 is shorter than the length L1 of a fin section 24 in the tube side-by-side placement direction. Moreover, the openings 23*a* of adjacent fin sections 24 are not equally spaced from one another. That is, the length L3 of each space is different in every place in a direction parallel with the length of the fin material 50. The pattern 3 is formed such that with one cycle being a pattern of placement having five openings 23*a* in a direction parallel with the length of the fin material 50, this pattern of placement is periodically repeated in a direction parallel with the length of the fin material 50.

A fin material 50 yet to be subjected to corrugating is processed so that openings 23*a* that are to become drain slits 23 are sized and placed in the foregoing pattern, and a corrugated fin 2 subjected to corrugating thus can be formed such that there is a well-balanced mixture of drain apices 20*a* and non-drain apices 20*b*. In particular, because the proportion of drain apices 20*a* to non-drain apices 20*b* in one corrugated fin 2 can be adjusted by adjusting L3, a balance between drainage capacity and heat-transfer performance can be achieved on the basis of design.

(Pattern of Placement 4)

Figure 16:
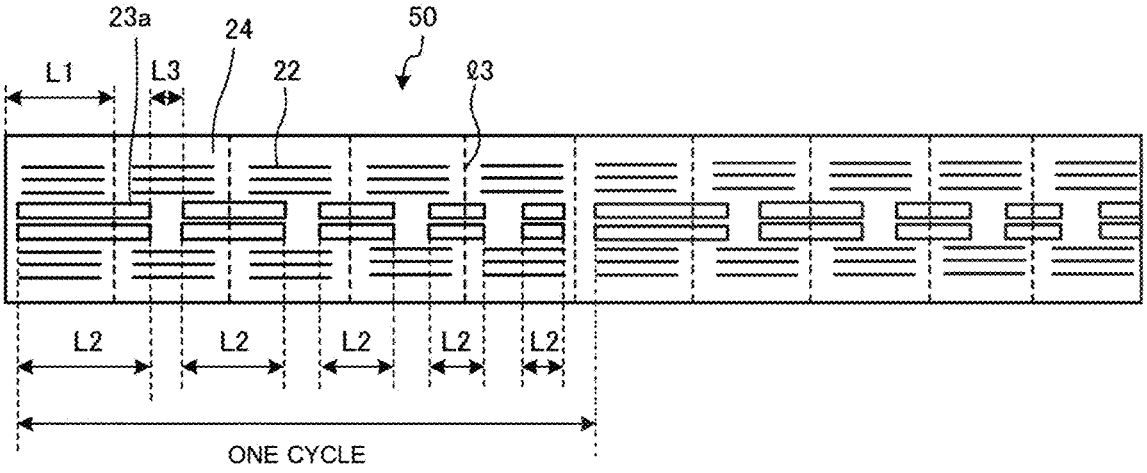
FIG. 16 is an explanatory diagram of a pattern of placement 4 of openings for drain slits in a corrugated fin according to Embodiment 1.

FIG. 16 is an explanatory diagram of a pattern of placement 4 of openings for drain slits in a corrugated fin according to Embodiment 1.

In the pattern of placement 4, the width L2 of an opening 23*a* that is to become a drain slit 23 is different in every place. Moreover, the openings 23*a* of adjacent fin sections 24 are equally spaced from one another. That is, the length L3 of each space is the same in every place in a direction parallel with the length of the fin material 50. The pattern 4 is formed such that with one cycle being a pattern of placement having five openings 23*a* in a direction parallel with the length of the fin material 50, this pattern of placement is periodically repeated in a direction parallel with the length of the fin material 50.

A fin material 50 yet to be subjected to corrugating is processed so that openings 23*a* that are to become drain slits 23 are sized and placed in the foregoing pattern, and a corrugated fin 2 subjected to corrugating thus can be formed such that there is a well-balanced mixture of drain apices 20*a* and non-drain apices 20*b*. In particular, because the proportion of drain apices 20*a* to non-drain apices 20*b* in one corrugated fin 2 can be adjusted by adjusting L2, a balance between drainage capacity and heat-transfer performance can be achieved on the basis of design.

In any of the foregoing patterns of placement 1 to 4, the fin material 50 is formed such that a particular pattern of placement is periodically repeated in a direction parallel with the length of the fin material 50. For this reason, a corrugated fin 2 fabricated by subjecting the fin material 50 to corrugating is formed such that fin sections 24 are identical in position of the drain slits 23 to each other in the tube side-by-side placement direction and are periodically and repeatedly located every several fin sections in the tube axial direction. By having this configuration, the heat exchanger 10 can be configured as a result such that there is a well-balanced mixture of drain apices 20*a* and non-drain apices 20*b*. This results in making it possible to obtain a heat exchanger 10 with improved drainage capacity while maintaining heat-transfer performance.

[Punching of Drain Slits 23]

Figure 17:
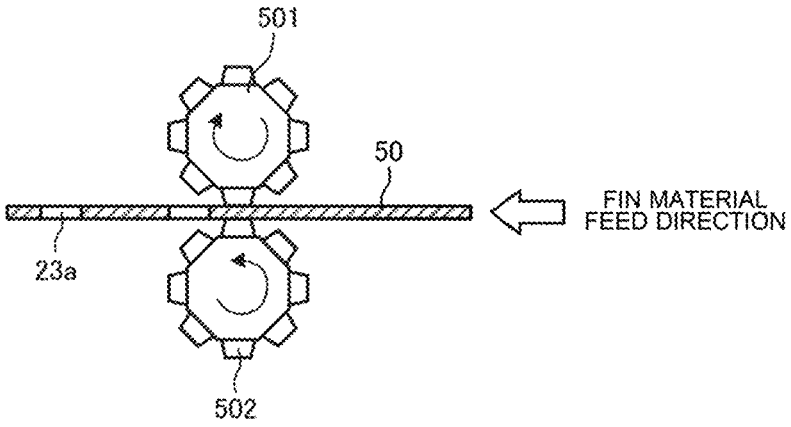
FIG. 17 is an explanatory diagram of punching of drain slits by corrugated cutters.

In a case, such as the patterns of placement 1 to 4, in which a particular pattern of placement is periodically repeated in a direction parallel with the length of the fin material 50, processing of drain slits 23 can be performed with corrugated cutters, corrugated punching rollers, or other devices. FIG. 17 shows how punching is performed with corrugated cutters.

FIG. 17 is an explanatory diagram of punching of drain slits by corrugated cutters.

Two corrugated cutters 501 and 502 are placed opposite each other, and a fin material 50 is placed between the two corrugated cutters 501 and 502. The fin material 50 is fed in the direction of an arrow outlined with a blank inside, and the two corrugated cutters 501 and 502 thus rotate in the directions of solid arrows. While the two corrugated cutters 501 and 502 are rotating, openings 23*a* that are to become drain slits 23 are punched in the fin material 50.

By thus using corrugated cutters or corrugated punching rollers for processing of drain slits 23, the processing speed at which a corrugated fin 2 is manufactured can be increased. The present disclosure is not limited to a configuration in which a pattern of placement is periodically repeated, although manufacturing cannot be performed with corrugated cutters in a case in which a pattern of placement is not configured to be periodically repeated.

[Effects]

As described above, the heat exchanger 10 of Embodiment 1 is a heat exchanger including the plurality of flat heat-transfer tubes 1 each formed in a flat shape in cross-section, provided with a plurality of flow passages formed by through holes, disposed to stand in an up-down direction, and placed side by side and spaced from one another in a direction orthogonal to a direction of flow of air; and the corrugated fin 2 placed between the plurality of flat heat-transfer tubes 1, The corrugated fin 2 is formed such that the fin sections 24, which are plate-shaped, are joined together one after another in a wave shape in a tube axial direction of the plurality of flat heat-transfer tubes 1. The fin sections 24 each have a drain slit 23 formed such that the drain slit extends in a tube side-by-side placement direction that is a direction in which the plurality of flat heat-transfer tubes 1 are placed side by side and through which water on an upper surface of the fin section 24 falls for drainage and the plurality of louvers 22 each having a louver slit 22*a* extending in the tube side-by-side placement direction and a plate portion 22*b* inclined to a flat-plate portion 21, which is tabular-shaped, in the fin section 24. The plurality of louvers 22 are divided into a first louver group 22A formed further upstream in the direction of flow of air than the drain slit 23 and a second louver group 22B formed further downstream in the direction of flow of air than the drain slit 23. The plate portions 22*b* of the first louver group 22A and the plate portions 22*b* of the second louver group 22B are inclined to the flat-plate portion 21 and inclined in respective directions that are opposite to each other. The plurality of drain slits 23 are formed between the first louver group 22A and the second louver group 22B at an interval in the direction of flow of air.

According to the foregoing configuration, the heat exchanger 10 of Embodiment 1 can improve drainage capacity while maintaining heat-transfer capacity.

The interval between drain slits 23 is shorter than the length Ss of a drain slit 23 in the direction of flow of air. The interval between drain slits 23 is a length hs in the direction of flow of air of a heat-transfer region 503 that is a region of the fin section 24 interposed in the direction of flow of air by a plurality of drain slits 23 formed. Therefore, the length hs of the heat-transfer region 503 in the direction of flow of air is shorter than the length Ss of a drain slit 23 in the direction of flow of air.

According to the foregoing configuration, the heat exchanger 10 of Embodiment 1 can improve drainage capacity while maintaining heat-transfer capacity.

Further, the heat exchanger 10 of Embodiment 1 is formed such that when the inter-louver air passage cross-sectional area AL is defined as $AL=((Lp\times\sin\theta)-t)\times NL\times Lw$ and the drain slit opening area As is defined as $As=Ns\times Sw\times Ss$, $1\leq AL/As\leq 4$ is satisfied.

According to the foregoing configuration, the heat exchanger 10 of Embodiment 1 can improve drainage capacity while maintaining heat-transfer capacity.

The angle of the plate portion 22*b* of each of the plurality of louvers 22 inclined to the flat-plate portion 21 ranges from 15 degrees to 30 degrees.

According to the foregoing configuration, the heat exchanger 10 of Embodiment 1 can achieve compatibility between improvement in drainage capacity and ease of flow of air.

The flat-plate portion 21 has two ends in the tube side-by-side placement direction and the fin section 24 has, at each of the two ends of the flat-plate portion 21, an apex 20 joined to the plurality of flat heat-transfer tubes 1. Some of the plurality of fin sections 24 have the drain slits 23 formed in positions at which the drain slits 23 overlap the apices 20 at one or both of the two ends when the drain slits 23 are seen from an angle parallel with the tube axial direction. Further, some of the plurality of fin sections 24 have the drain slits 23 formed in positions at which the drain slits 23 do not overlap both of the apices 20 at the two ends when the drain slits 23 are seen from an angle parallel with the tube axial direction.

According to the foregoing configuration, the heat exchanger 10 of Embodiment 1 can achieve a balance between drainage capacity and heat-transfer performance on the basis of design.

The drain slits 23 in ones of the fin sections adjacent to each other in the tube axial direction are displaced from each other in the tube side-by-side placement direction.

According to the foregoing configuration, the heat exchanger 10 of Embodiment 1 can improve drainage capacity.

The corrugated fin 2 is formed such that ones of the fin sections 24 identical in position of the drain slits 23 to each other in the direction of flow of air are periodically and repeatedly located in the tube axial direction.

The foregoing configuration makes it possible to obtain a heat exchanger 10 with improved drainage capacity while maintaining heat-transfer performance.

Embodiment 2

Embodiment 2 relates to a configuration including a plurality of the heat exchangers 10 of Embodiment 1 in the direction of flow of air. The following description is focused on points of difference of Embodiment 2 from Embodiment 1, and configurations of Embodiment 2 that are similar to those of Embodiment 1 are not described.

Figure 18:
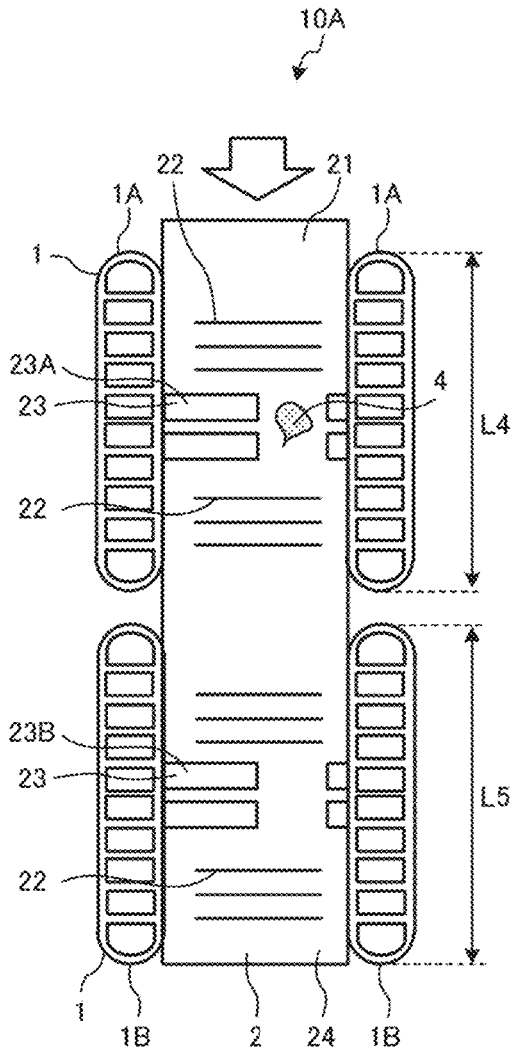
FIG. 18 is an enlarged schematic plan view of part of a heat exchanger according to Embodiment 2.
Figure 19:
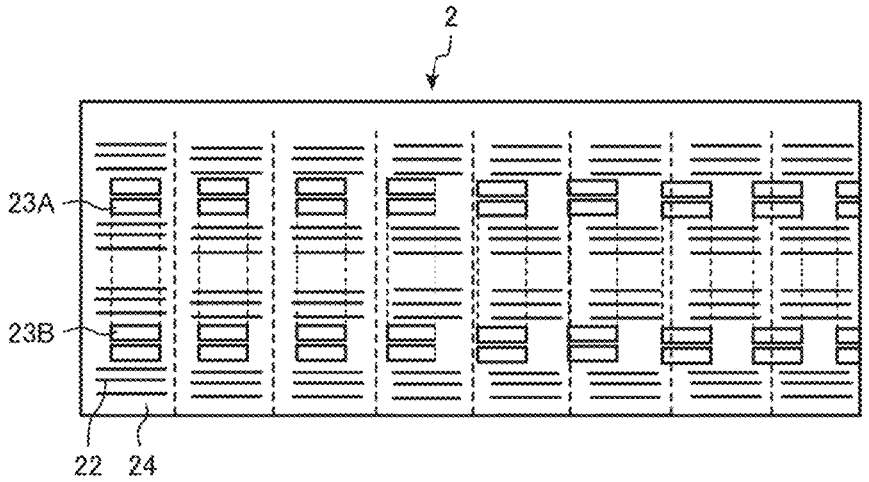
FIG. 19 is a diagram showing a pattern of placement of openings for drain slits in a corrugated fin of the heat exchanger of FIG. 18.

FIG. 18 is an enlarged schematic plan view of part of a heat exchanger according to Embodiment 2. FIG. 19 is a diagram showing a pattern of placement of openings for drain slits in a corrugated fin of the heat exchanger of FIG. 18.

The heat exchanger 10A according to Embodiment 2 is formed such that a plurality of flat heat-transfer tubes 1 are placed in two rows that are spaced from one another in the direction of flow of air and a corrugated fin 2 is provided commonly for the two rows. Here, flat heat-transfer tubes 1 located windward (also sometimes referred to as "upstream in the direction of flow of air") are defined as flat heat-transfer tubes 1A and flat heat-transfer tubes 1 located leeward (also sometimes referred to as "downstream in the direction of flow of air") are defined as flat heat-transfer tubes 1B. The dimension L4 in a long direction of a flat cross-section of a flat heat-transfer tube 1A and the dimension L5 in a long direction of a flat cross-section of a flat heat-transfer tube 1B may be equal to or different from each other. Although the flat heat-transfer tubes 1 are formed in two rows here, there may be three or more rows.

The corrugated fin 2 of the heat exchanger 10A according to Embodiment 2 is provided commonly for the flat heat-transfer tubes 1A and the flat heat-transfer tubes 1B, and are joined to the flat heat-transfer tubes 1A and the flat heat-transfer tubes 1B by brazing. The corrugated fin 2 includes louvers 22 and drain slits 23 in correspondence with each row.

Drain slits 23 located windward are first drain slits 23A formed in a range corresponding to the length in a long direction of a flat cross-section of a flat heat-transfer tube 1A. A plurality of louvers 22 located windward are divided into a first louver group 22A formed further upstream in the direction of flow of air than the first drain slits 23A and a second louver group 22B formed further downstream in the direction of flow of air than the drain slits 23. Although not illustrated, the plate portions 22*b* of the first louver group 22A and the plate portions 22*b* of the second louver group 22B are inclined to the flat-plate portion 21 and inclined in respective directions that are opposite to each other.

Drain slits 23 located leeward are second drain slits 23B formed in a range corresponding to the length in a long direction of a flat cross-section of a flat heat-transfer tube 1B, A plurality of louvers 22 located leeward are divided into a first louver group 22A formed further upstream in the direction of flow of air than the second drain slits 23B and a second louver group 22B formed further downstream in the direction of flow of air than the second drain slits 23B. Although not illustrated, the plate portions 22*b* of the first louver group 22A and the plate portions 22*b* of the second louver group 228 are inclined to the flat-plate portion 21 and inclined in respective directions that are opposite to each other.

Although, in FIG. 18, two rows of first drain slits 23A and two rows of second drain slits 238 are formed in the direction of flow of air and one row is formed by two first drain slits 23A and another row is formed by two second drain slits 238 in the tube side-by-side placement direction, this configuration is not intended to impose any limitation. Further, although, in FIGS. 18 and 19, the first drain slits 23A and the second drain slits 238 are identical in position in the tube side-by-side placement direction to each other in the fin section 24, the first drain slits 23A and the second drain slits 238 may be different in position in the tube side-by-side placement direction from each other in the fin section 24 as shown in FIGS. 20 and 21.

Figure 20:
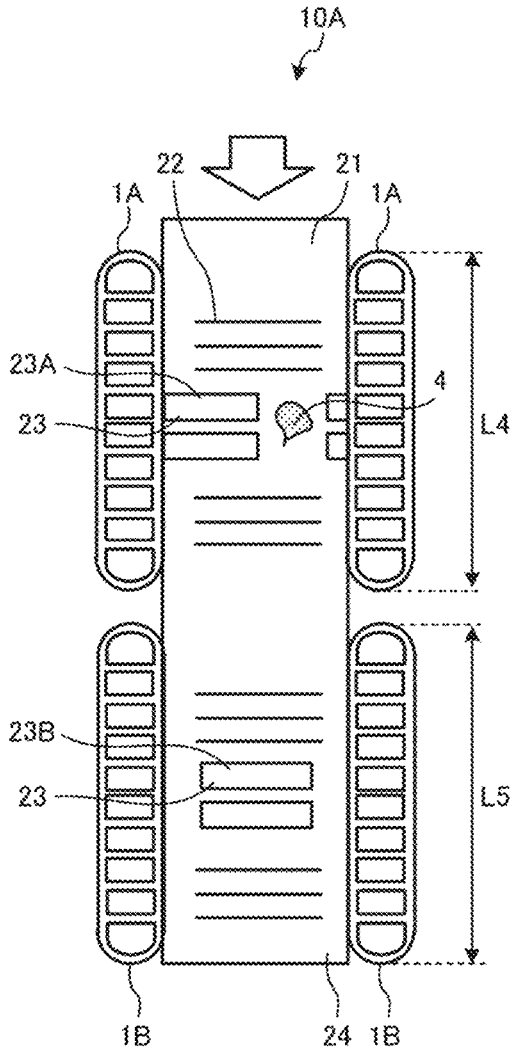
FIG. 20 is an enlarged schematic plan view of part of a modification of a heat exchanger 10 according to Embodiment 2.
Figure 21:
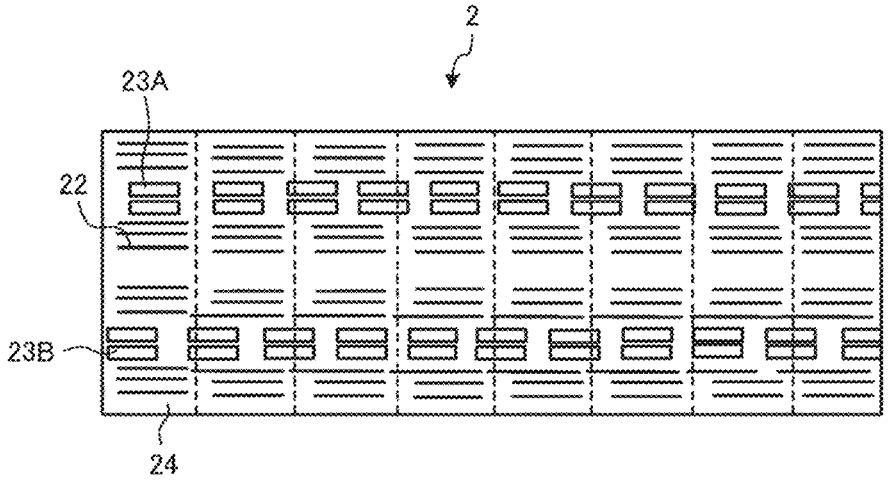
FIG. 21 is a diagram showing a pattern of placement of openings for drain slits in a corrugated fin of the heat exchanger of FIG. 19.

FIG. 20 is an enlarged schematic plan view of part of a modification of the heat exchanger according to Embodiment 2. FIG. 21 is a diagram showing a pattern of placement of openings for drain slits in a corrugated fin of the heat exchanger of FIG. 19.

In the heat exchanger 10A of this modification, the first drain slits 23A and the second drain slits 238 are different in position in the tube side-by-side placement direction from each other in the fin section 24.

[Adjustment of Drainage Capacity and Heat-Transfer Capacity]

In the heat exchanger 10A according to Embodiment 2, drainage capacity and heat-transfer performance can be adjusted separately for the windward side and the leeward side by adjusting the positions of the drain slits 23 or the widths of the drain slits 23. Specifically, drainage capacity can be improved by increasing the number of drain apices 20*a* by adjusting the positions of the drain slits 23, and heat-transfer performance can be improved by reducing the number of drain apices 20*a*. Further, drainage capacity can be improved by increasing the widths of the drain slits 23, and heat-transfer performance can be improved by reducing the widths of the drain slits 23.

Incidentally, in a case in which the heat exchanger 10A is used as an evaporator, condensed water is easily produced on the windward side, as the windward side is higher in heat-transfer performance than the leeward side. Therefore, drainage capacity is required on the windward side. Meanwhile, heat-transfer performance is more required on the leeward side than drainage capacity, as the leeward side is lower in heat-transfer performance than the windward side and less condensed water is produced on the leeward side. That is, in a case in which the heat exchanger 10A is used as an evaporator, a configuration is required in which drainage is prioritized on the windward side and heat transfer is prioritized on the leeward side.

To achieve this configuration, it is only necessary to adjust the positions of the drain slits 23 in the following manner That is, the number of drain apices 20*a* located windward in one corrugated fin 2 is defined as N, and the number of drain apices 20*a* located leeward is defined as M. In this case, the positions of the first drain slits 23A and the second drain slits 23B are adjusted so that N>M is satisfied. This makes it possible to configure a heat exchanger such that drainage is prioritized on the windward side and heat transfer is prioritized on the leeward side. Further, a sum of drain slit widths of the plurality of first drain slits 23A located windward in one corrugated fin 2 is defined as $SW_F$, and a sum of drain slit widths of the plurality of second drain slits 23B located windward is defined as $Sw_B$. At this time, a configuration is set up in which the relationship $Sw_F > Sw_B$ is satisfied. This makes it possible to configure a heat exchanger such that drainage is prioritized on the windward side and heat transfer is prioritized on the leeward side.

Since the heat exchanger 10A can be thus formed such that heat transfer is prioritized on the leeward side, the difference in heat-transfer performance between the windward side and the leeward side can be reduced. Since the difference in heat-transfer performance between the windward side and the leeward side can be reduced, the thickness of frost that forms on surfaces of the fin sections under low-temperature air conditions can be made almost uniform. Since the thickness of frost that forms on the surfaces of the fin sections can be made almost uniform, heat exchange performance under low-temperature air conditions is improved as a result.

[Effects]

As noted above, the heat exchanger 10A of Embodiment 2 brings about the following effects in addition to effects that are similar to those of Embodiment 1. The heat exchanger 10A of Embodiment 2 is formed such that the plurality of flat heat-transfer tubes 1 arranged in the tube side-by-side placement direction are placed in a plurality of rows and are spaced from one another in the direction of flow of air and the corrugated fin 2 is provided commonly for the plurality of rows. This configuration makes it possible to adjust drainage capacity and heat-transfer performance on the windward side and the leeward side by adjusting either or both the positions and drain slit widths of the first drain slits 23A and the second drain slit 238 in each row. This allows the heat exchanger 10A of Embodiment 2 to improve heat exchange performance under low-temperature air conditions.

Embodiment 3

Embodiment 3 relates to a configuration in which the heat exchanger 10A of Embodiment 2 further includes an interrow drain slit. The following description is focused on points of difference of Embodiment 3 from Embodiment 2, and configurations of Embodiment 3 that are similar to those of Embodiment 2 are not described.

Figure 22:
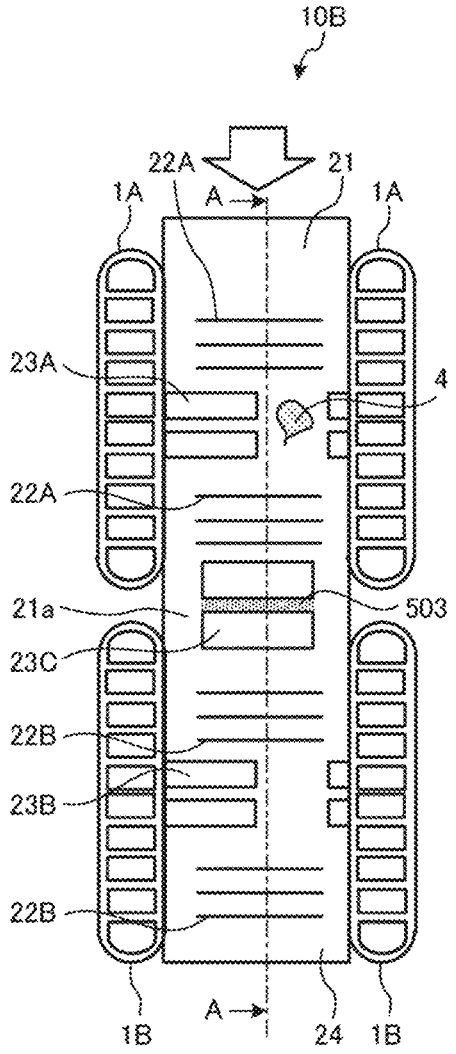
FIG. 22 is an enlarged schematic plan view of part of a heat exchanger according to Embodiment 3.

FIG. 22 is an enlarged schematic plan view of part of a heat exchanger according to Embodiment 3.

The heat exchanger 10B according to Embodiment 3 is formed such that an interrow drain slit 23C is formed in a non-junction region 21*a* that is not joined to the flat heat-transfer tubes 1. The non-junction region 21*a* is a portion of the flat-plate portion 21 situated between the flat heat-transfer tubes 1A and the flat heat-transfer tubes 1B. The interrow drain slit 23 is a through hole opened in the corrugated fin 2. Providing the interrow drain slit 23C in the non-junction region 21*a* makes it possible to improve drain capacity in a region where there is a decrease in heat-transfer performance. Although FIG. 22 shows an example in which interrow drain slits 23C are formed in two rows in the direction of flow of air, there may be one row formed by an interrow drain slit 23C or three or more rows formed by an interrow drain slit 23C. Further, although, in FIG. 22, the interrow drain slits 23C of the two rows are aligned in the tube side-by-side placement direction, the interrow drain slits 23C may be displaced as shown in FIG. 23.

Figure 23:
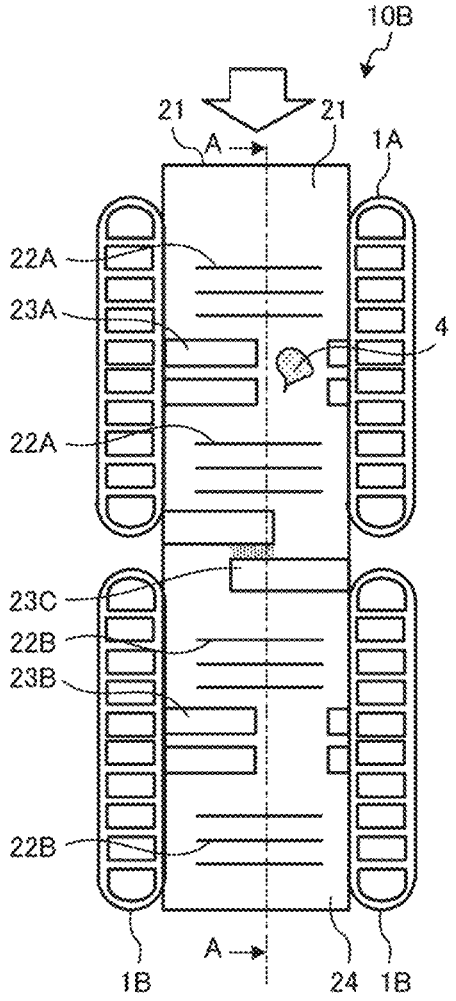
FIG. 23 is an enlarged schematic plan view of part of a modification of the heat exchanger according to Embodiment 3.

FIG. 23 is an enlarged schematic plan view of part of a modification of a heat exchanger according to Embodiment 3.

In the heat exchanger 10B of this modification, the interrow drain slits 23C of the two rows are displaced from each other in the tube side-by-side placement direction.

Figure 24:
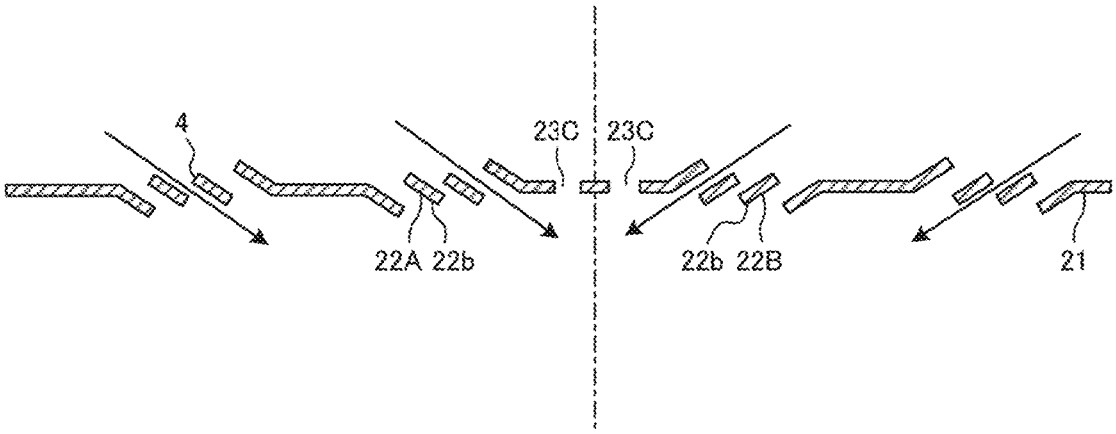
FIG. 24 is a cross-sectional view taken along line A-A in FIGS. 22 and 23.

FIG. 24 is a cross-sectional view taken along line A-A in FIGS. 22 and 23. The dot-and-dash line of FIG. 24 is a center line indicating the middle positions in the direction of flow of air of interrow drain slits 23C formed in two rows. The arrows of FIG. 24 indicate the flow of condensed water during drainage.

The heat exchanger 10B of Embodiment 3 uses the interrow drain slits 23C as main drain slits. For this reason, the interrow drain slits 23C are drain slits that divide the plurality of louvers 22 into the first louver group 22A and the second louver group 22B. That is, the first louver group 22A is a louver group located further upstream in the direction of flow of air than the interrow drain slits 23C, and the second louver group 22B is a louver group located further downstream in the direction of flow of air than the interrow drain slits 23C. Moreover, as described in Embodiment 1, the plate portions 22*b* of the first louver group 22A and the plate portions 22*b* of the second louver group 22B are inclined to the flat-plate portion 21 and inclined in respective directions that are opposite to each other. Such a configuration causes condensed water having flowed along the plate portions 22*b* of the louvers 22 to be guided toward the interrow drain slits 23C of a lower fin section 24, making it possible to improve drainage capacity.

The opening area of each of the interrow drain slits 23C is larger than the opening area of each of the first drain slits 23A and the second drain slits 238. In this configuration, condensed water is guided toward the interrow drain slits 23C. For this reason, since the opening area of each of the interrow drain slits 23C is larger than the opening area of each of the first drain slits 23A and the second drain slits 23B, higher drainage capacity can be achieved than in a case in which the opening areas are equal to each other. Although it is preferable that from the point of view of improvement in drainage capacity that the opening area of each of the interrow drain slits 23C be larger than the opening area of each of the first drain slits 23A and the second drain slits 23B, the opening areas may be equal to each other. Further, although an interrow drain slit 23C may be formed in one row, it is more preferable for a greater effect of improvement in drainage capacity that interrow drain slits 23C be formed in a plurality of rows. The first drain slits 23A, the second drain slits 23B, and the interrow drain slits 23C may be aligned to or displaced from each other in the tube side-by-side placement direction.

Incidentally, a comparison between the configuration of FIG. 22 and the configuration of FIG. 23, the configuration of FIG. 23 is smaller than the configuration of FIG. 22 in terms of the area of a heat-transfer region 503 that is formed between the interrow drain slits 23C of the of the two rows in the direction of flow of air. In each of FIGS. 22 and 23, the heat-transfer region 503 is indicated by half-tone dot meshing. The heat-transfer region 503 can be said to be a low-strength portion, as it is formed between the interrow drain slits 23C. The configuration FIG. 23 makes it possible to make the area of this low-strength portion smaller than the area in the configuration of FIG. 23, thus making it possible to configure a heat exchanger with higher fin strength than the heat exchanger of the configuration of FIG. 22.

[Effects]

As described above, the heat exchanger 10B of Embodiment 3 can bring about improvement in drainage capacity in addition to effects that are similar to those of Embodiment 2, as the interrow drain slits 23C are formed in a position corresponding to a space between each adjacent two of the rows of flat heat-transfer tubes 1 in the direction of flow of air. The plate portions 22*b* of the first louver group 22A located further upstream in the direction of flow of air than the interrow drain slits 23C and the plate portions 22*b* of the second louver group 22B located further downstream in the direction of flow of air than the interrow drain slits 23C are inclined to the flat-plate portion 21 and inclined in respective directions that are opposite to each other. This causes condensed water to be guided toward the interrow drain slits 23C, making it possible to improve drainage capacity. Further, since the opening area of each of the interrow drain slits 23C is larger than the opening area of each of the first drain slits 23A and the second drain slits 23B, which are drain slits other than the interrow drain slits, higher drainage capacity can be achieved than in a case in which the opening areas are equal to each other.

Embodiment 4

Embodiment 4 is formed such that the upstream protruding portion 2*a* of a fin section 24 in the heat exchanger 108 of Embodiment 3 is thickened. The following description is focused on points of difference of Embodiment 4 from Embodiment 3, and configurations of Embodiment 4 that are similar to those of Embodiment 3 are not described.

Figure 25:
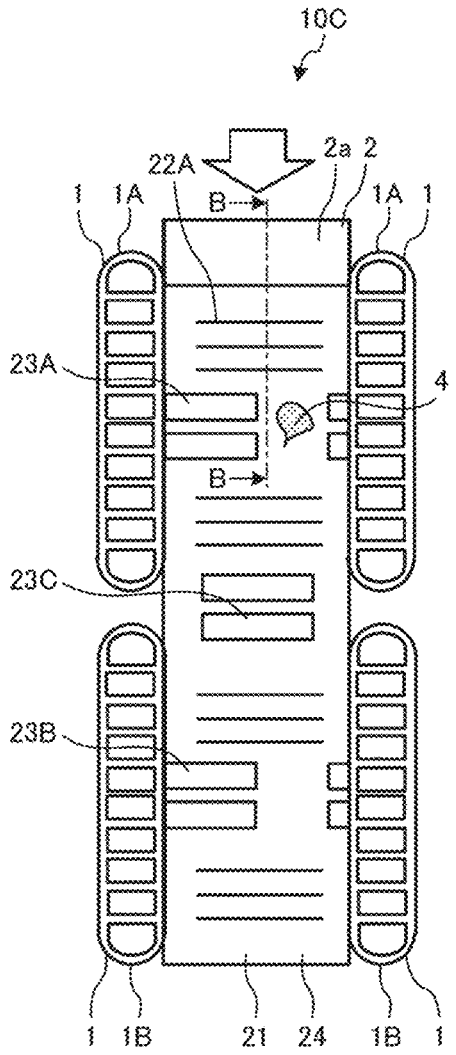
FIG. 25 is an enlarged schematic plan view of part of a heat exchanger according to Embodiment 4.
Figure 26:
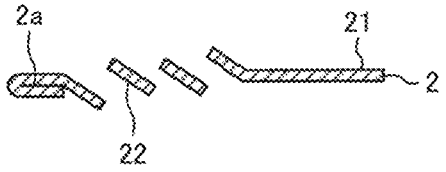
FIG. 26 is a cross-sectional view taken along line B-B in FIG. 25.

FIG. 25 is an enlarged schematic plan view of part of a heat exchanger according to Embodiment 4. FIG. 26 is a cross-sectional view taken along line B-B in FIG. 25.

In the heat exchanger 10C of Embodiment 4, the thickness of the upstream protruding portion 2*a* of the corrugated fin 2 is greater than the thickness of a portion of the corrugated fin 2 other than the upstream protruding portion 2*a*. As shown in FIG. 26, the upstream protruding portion 2*a* is formed to be thick by folding back a portion of the fin section 24 protruding further upstream than the flat heat-transfer tubes 1.

In a case in which the heat exchanger 10C is used as an evaporator, condensed water is easily produced on the upstream protruding portion 2*a* of the corrugated fin 2, with which air collides first. For this reason, frost easily forms on the upstream protruding portion 2*a* under low-temperature air conditions, and the upstream protruding portion 2*a* is required to have the strength to withstand frost formation.

To address this problem, Embodiment 4 is formed such that the upstream protruding portion 2*a* of the corrugated fin 2 is thicker than a portion of the corrugated fin 2 that is other than the upstream protruding portion 2*a*. This makes it possible to ensure the strength of the upstream protruding portion 2*a* and inhibit deformation of the upstream protruding portion 2*a* in case of frost formation.

[Effects]

As described above, the heat exchanger 10C of Embodiment 4 brings about the following effects in addition to effects that are similar to those of Embodiment 3, as the upstream protruding portion 2*a* of the corrugated fin 2 is thicker than a portion of the corrugated fin 2 that is other than the upstream protruding portion 2*a*. That is, the strength of the upstream protruding portion 2*a* can be improved, and deformation of the upstream protruding portion 2*a* in a case in which frost forms on the upstream protruding portion 2*a* can be inhibited. When the upstream protruding portion 2*a* deforms, the flow passage of air is prevented, with the result that a deterioration in heat exchange capacity is invited. However, in Embodiment 4, heat exchange capacity can be maintained since deformation of the upstream protruding portion 2*a* can be inhibited.

The upstream protruding portion 2*a* thickened by folding back a portion of the fin protruding further upstream than the flat heat-transfer tubes 1. This makes it possible to easily form a thick upstream protruding portion 2*a*. From the point of view of ensuring the strength of the upstream protruding portion 2*a*, it is conceivable that the thickness of the whole corrugated fin may be increased. However, in this case, the thicknesses of the plate portions 22*b* of the louvers 22 increase too. This causes a decrease in the inter-louver air passage cross-sectional area and causes a deterioration in the capacity of drainage of condensed water through the space between the louvers. On the other hand, in the heat exchanger 10C of Embodiment 4, only the upstream protruding portion 2*a* is thickened. This allows the heat exchanger 10C of Embodiment 4 to improve the strength of the upstream protruding portion 2*a* without inviting a deterioration in drainage capacity.

Although Embodiment 4 is formed such that the upstream protruding portion 2*a* of the flat-plate portion 21 is thickened in the heat exchanger of Embodiment 3, Embodiment 4 may be formed such that the upstream protruding portion 2*a* of the flat-plate portion 21 is thickened in the heat exchanger of Embodiment 1 or 2.

Embodiment 5

Embodiment 5 relates to an air-conditioning apparatus as an example of a refrigeration cycle apparatus including a heat exchanger of any of Embodiments 1 to 4.

Figure 27:
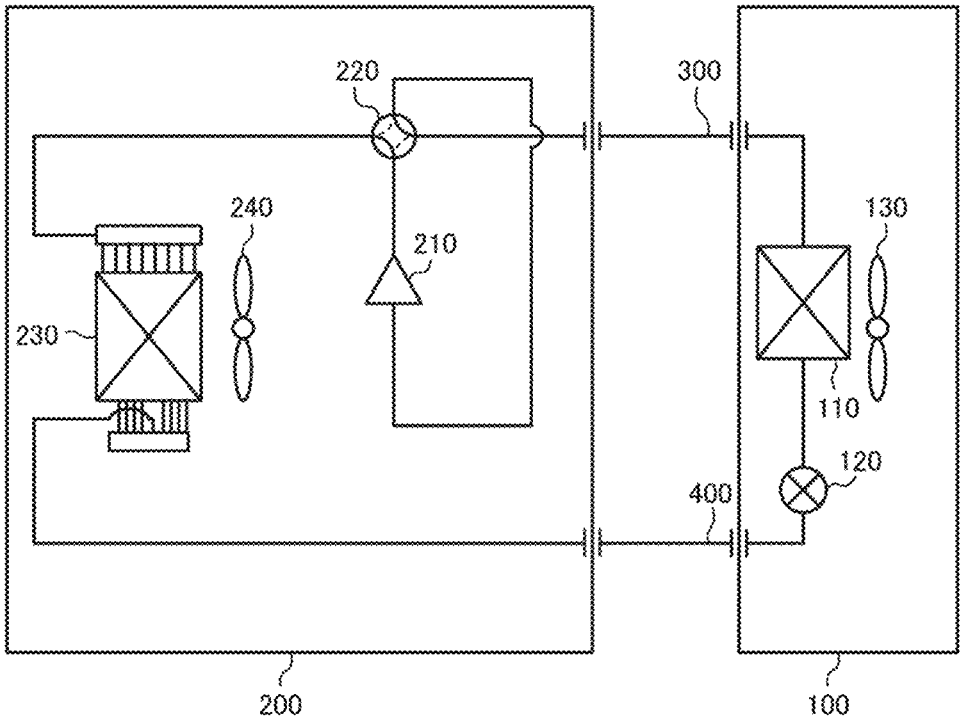
FIG. 27 is a diagram showing a configuration of an air-conditioning apparatus according to Embodiment 5.

FIG. 27 is a diagram showing a configuration of an air-conditioning apparatus according to Embodiment 5.

The air-conditioning apparatus uses a heat exchanger of any of Embodiments 1 to 4 as an outdoor heat exchanger 230. Note, however, that this is not intended to impose any limitation. A heat exchanger of any of Embodiments 1 to 4 may be used as an indoor heat exchanger 110, or heat exchangers of any of Embodiments 1 to 4 may be used as both the outdoor heat exchanger 230 and the indoor heat exchanger 110.

As shown in FIG. 27, the air-conditioning apparatus forms a refrigerant circuit in which an outdoor unit 200 and an indoor unit 100 are connected with a gas refrigerant pipe 300 and a liquid refrigerant pipe 400. The outdoor unit 200 includes a compressor 210, a four-way valve 220, the outdoor heat exchanger 230, and an outdoor fan 240. Although a case is described in which one outdoor unit 200 and one indoor unit 100 are connected by pipes in the air-conditioning apparatus of Embodiment 5, the numbers are arbitrary.

The compressor 210 compresses and discharges sucked refrigerant. Although not limited in particular, the compressor 210 can change the capacity of the compressor 210 by arbitrarily varying the operating frequency, for example, through an inverter circuit or other circuits. The four-way valve 220 is a valve configured to switch the flows of refrigerant between cooling operation and heating operation.

The outdoor heat exchanger 230 exchanges heat between refrigerant and outdoor air. During heating operation, the outdoor heat exchanger 230 serves as an evaporator to evaporate and gasify the refrigerant. Further, during cooling operation, the outdoor heat exchanger 230 serves as a condenser to condense and liquefy the refrigerant. The outdoor fan 240 sends the outdoor air to the outdoor heat exchanger 230 and facilitates heat exchange at the outdoor heat exchanger 230.

Meanwhile, the indoor unit 100 includes the indoor heat exchanger 110, a decompression device 120, and an indoor fan 130. The indoor heat exchanger 110 exchanges heat between air in a room to be air-conditioned and refrigerant. During heating operation, the indoor heat exchanger 110 serves as a condenser to condense and liquefy the refrigerant. Further, during cooling operation, the indoor heat exchanger 110 serves as an evaporator to evaporate and gasify the refrigerant.

The decompression device 120 decompresses and expands the refrigerant. The decompression device 120 is formed, for example, by an electronic expansion valve or other devices. In a case in which the decompression device 120 is formed by an electronic expansion valve, the decompression device 120 adjusts its opening degree in accordance with an instruction from a controller (not illustrated) or other devices. The indoor fan 130 passes the air in the room through the indoor heat exchanger 110 and supplies, into the room, the air passed through the indoor heat exchanger 110.

Next, the actions of the pieces of equipment of the air-conditioning apparatus are described with reference to the flow of refrigerant, First, heating operation is described. During heating operation, the four-way valve 220 is switched to a state illustrated by dotted lines of FIG. 27. High-temperature and high-pressure gas refrigerant compressed and discharged by the compressor 210 passes through the four-way valve 220 and flows into the indoor heat exchanger 110. The gas refrigerant having flowed into the indoor heat exchanger 110 condenses and liquefies by exchanging heat with air in a space to be air-conditioned. The refrigerant having liquefied is decompressed by the decompression device 120 into two-phase gas-liquid refrigerant and then flows into the outdoor heat exchanger 230. The refrigerant having flowed into the outdoor heat exchanger 230 evaporates and gasifies by exchanging heat with outdoor air sent from the outdoor fan 240. The refrigerant having gasified passes through the four-way valve 220 and is sucked again into the compressor 210. Such circulation of the refrigerant causes the air-conditioning apparatus to perform air conditioning related to heating.

Next, cooling operation is described. During cooling operation, the four-way valve 220 is switched to a state illustrated by solid lines of FIG. 27. High-temperature and high-pressure gas refrigerant compressed and discharged by the compressor 210 passes through the four-way valve 220 and flows into the outdoor heat exchanger 230. The gas refrigerant having flowed into the outdoor heat exchanger 230 condenses and liquefies by exchanging heat with outdoor air supplied by the outdoor fan 240. The refrigerant having liquefied is decompressed by the decompression device 120 into two-phase gas-liquid refrigerant and then flows into the indoor heat exchanger 110. The refrigerant having flowed into the indoor heat exchanger 110 evaporates and gasifies by exchanging heat with air in the space to be air-conditioned. The refrigerant having gasified passes through the four-way valve 220 and is sucked again into the compressor 210. Such circulation of the refrigerant causes the air-conditioning apparatus to perform air conditioning related to cooling.

[Effects]

Since the air-conditioning apparatus of Embodiment 5 includes a heat exchanger of any of Embodiments 1 to 4, it is possible to improve drainage capacity while maintaining heat-transfer performance in the heat exchanger.

Although, in Embodiment 5, the refrigeration cycle apparatus has been described as being an air-conditioning apparatus, this is not intended to impose any limitation. The refrigeration cycle apparatus may be a cooling apparatus configured to cool, for example, a refrigerating-freezing warehouse, a hot water supply apparatus, or other apparatuses.

Embodiment 6

Embodiment 6 is equivalent to a modification of the aforementioned Embodiment 3. The following description is focused on points of difference of Embodiment 6 from Embodiment 3, and configurations of Embodiment 6 that are similar to those of Embodiment 3 are not described.

Figure 28:
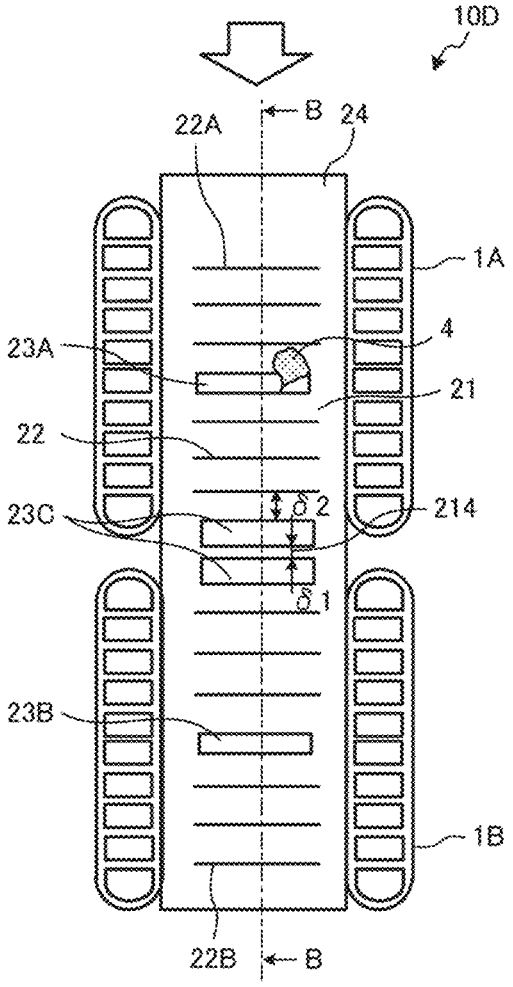
FIG. 28 is an enlarged schematic plan view of part of a heat exchanger according to Embodiment 6.
Figure 29:
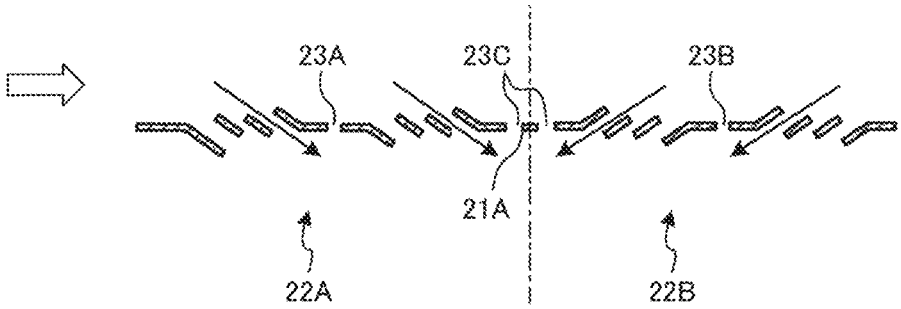
FIG. 29 is a cross-sectional view taken along line B-B in FIG. 23.

FIG. 28 is an enlarged schematic plan view of part of a heat exchanger according to Embodiment 6. FIG. 29 is a cross-sectional view taken along line B-B in FIG. 28. Embodiment 3 made no particular mention of the numbers of drain slits 23A and drain slits 23B, and FIG. 22 showed an example in which there are two drain slits 23A and two drain slits 23B. The drain slits 23A are drain slits formed in the middle of the first louver group 22A in the direction of flow of air, and the drain slits 23B are drain slits formed in the middle of the second louver group 22B in the direction of flow of air. On the other hand, the heat exchanger 10D of Embodiment 6 is formed such that the numbers of drain slits 23A and drain slits 23B are each limited to one as shown in FIG. 28. That is, the numbers of drain slits 23A and drain slits 23B are each not limited to plural numbers but may be one. It should be noted that there are a plurality of interrow drain slits 23C.

The drainage behavior of condensed water on a fin surface of Embodiment 6 is described. The condensed water on the fin surface is collected in the vicinity of an intermediate portion (hereinafter referred to as "near the center of the space between the rows") of the fin section 24 in the direction of flow of air (i.e. the direction of an arrow outlined with a blank inside in FIG. 28) by the first louver group 22A and the second louver group 22B and drained through the interrow drain slits 230. For this reason, the amount of condensed water near the center of the space between the rows is large. Therefore, the amounts of condensed water in the vicinity of the center of a region of formation of the first louver group 22A and in the vicinity of the center of a region of formation of the second louver group 22B are each relatively smaller than the amount of condensed water near the center of the space between the rows. In other words, this puts limits on drainage near the center of the space between the rows. The term "center" here means the center in the direction of flow of air.

Thus, the amounts of condensed water in the vicinity of the center of the region of formation of the first louver group 22A and in the vicinity of the center of the region of formation of the second louver group 22B are each relatively smaller than the amount of condensed water near the center of the space between the rows. For this reason, the heat exchanger 10D includes a plurality of interrow drain slits 23C, which are each relatively large in the amount of condensed water, and one drain slit 23A and one drain slit B, which are each relatively small in the amount of condensed water. This allows the heat exchanger 10D to excel in heat-transfer performance with improvement in capacity of drainage of condensed water.

Further, according to the distribution of condensed water based on an analysis by the inventors, it is more preferable for compatibility between improvement in drainage capacity and improvement in heat-transfer performance suited for the distribution of condensed water that the heat exchanger 10D satisfy the following relationship:

$$A_C > A_A \text{ or } A_C > A_B, \text{ preferably } A_C > A_A + A_B,$$

where $A_A$ [mm$^2$] is the opening area of a drain slit 23A formed in the middle of the first louver group 22A in the direction of flow of air, $A_B$ [mm$^2$] is the opening area of a drain slit 23B formed in the middle of the second louver group 22B in the direction of flow of air, and $A_C$ [mm$^2$] is the opening area of an interrow drain slit 230.

Further, although FIG. 28 shows a case in which the drain slit 23A, the drain slit 23B, and the interrow drain slits 23C are not periodically displaced in the tube side-by-side placement direction, the drain slit 23A, the drain slit 23B, and the interrow drain slits 23C may of course be formed to be periodically displaced as described in Embodiment 1.

Further, as described in Embodiment 1 too, a portion of the flat-plate portion 21 located between drain slits 23 also serves as a water conduit 21A, and in the configuration of Embodiment 6, a portion of the flat-plate portion 21 located between the interrow drain slits 23C is equivalent to a water conduit 21A. If this water conduit 21A is long in the direction of flow of air, the interval between the interrow drain slits 23C widens, the region of placement of the drain slits 23 and the louvers 22 narrows accordingly. For this reason, it is preferable that the water conduit 21A be formed to be as short as possible in the direction of flow of air. When the water conduit 21A is formed to be as short as possible in the direction of flow of air, the heat exchanger 10D can be mounted with drain slits 23 and louvers 22 at high densities in the fin section 24 for improved performance. Specifically, it is preferable that the water conduit 21A be formed so that the length $\delta_1$ [mm] of the water conduit 21A in the direction of flow of air satisfies $\delta_1 < \delta_2$, where $\delta_2$ [mm] is the distance in the direction of flow of air between one of the plurality of louvers 22 and one of the plurality of (here, two) drain slits 23 that are adjacent to each other in the direction of flow of air or, in other words, the distance in the direction of flow air between one of the plurality of louvers 22 that is at an end close to the center of the space between the row and the interrow drain slit 23C closest to this louver 22.

Figure 30:
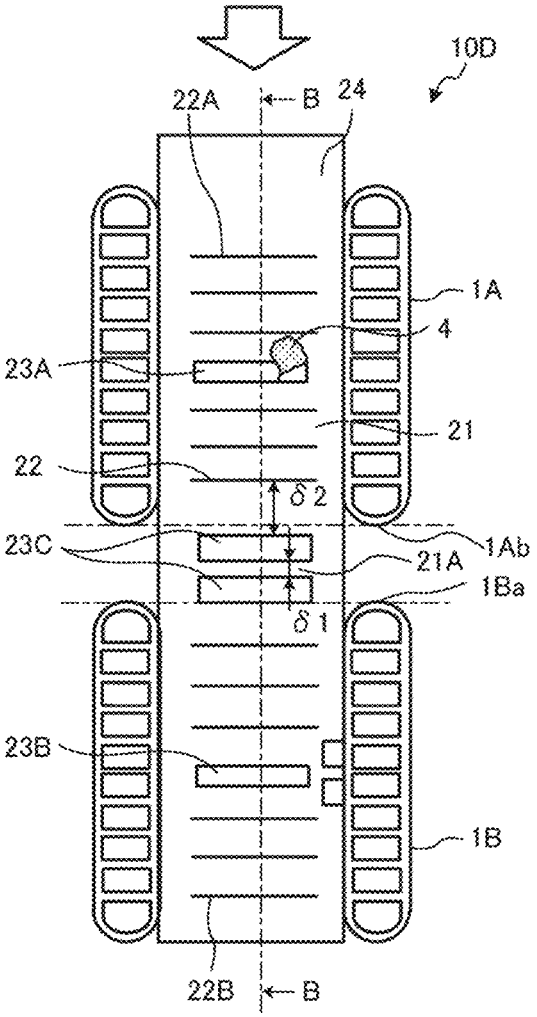
FIG. 30 is a diagram showing another example of a heat exchanger according to Embodiment 6.

FIG. 30 is a diagram showing another example of a heat exchanger according to Embodiment 6. In this example, the interrow drain slits 23C are formed in a portion of the fin section 24 situated between respective distal ends of the flat heat-transfer tube 1A and the flat heat-transfer tube 1B adjacent to each other in the direction of flow of air and the respective distal ends are opposite to each other. The opposite distal ends here include, on one hand, furthest leeward distal ends 1Ab (hereinafter referred to as "leeward distal ends 1Ab") of the flat heat-transfer tubes 1A and, on the other hand, furthest windward distal ends 1Ba (hereinafter referred to as "windward distal ends 1Ba") of the flat heat-transfer tubes 1B. It is even more preferable to provide the interrow drain slits 23C only in such a region or, in other words, a region in which no flat heat-transfer tubes are placed side by side, drainage capacity is thus improved for the following reason. In a configuration in which the interrow drain slits 23C are provided only in a region in which no flat heat-transfer tubes are placed side by side, condensed water 4 near the center of the space between the rows is intensively drained with effective use of three places, namely the interrow drain slits 23C, leeward end surfaces of the flat heat-transfer tubes 1A, and windward end surfaces of the flat heat-transfer tubes 1B.

[Effects]

As described above, the heat exchanger 10D of Embodiment 6 brings about effects that are similar to those of Embodiment 3. Further, since the length $\delta_1$ of the water conduit 21A in the direction of flow of air satisfies the relationship $\delta_1 < \delta_2$, the heat exchanger 10D can be mounted with drain slits 23 and louvers 22 at high densities in the fin section 24 for improved performance.

Further, the heat exchanger 10D of Embodiment 6 is formed such that the interrow drain slits 23C are formed in a portion of the fin section 24 situated between the leeward distal ends 1Ab of the flat heat-transfer tubes 1A and the windward distal ends 1Ba of the flat heat-transfer tubes 1B in the direction of flow of air. This causes the heat exchanger 10D to have improved drainage capacity.

Embodiment 7

Embodiment 7 differs from the heat exchanger 10D of Embodiment 6 in positional relationship between upstream ends of flat heat-transfer tubes 1A located windward and an upstream end of a corrugated fin 2. The following description is focused on points of difference of Embodiment 7 from Embodiment 6, and configurations of Embodiment 7 that are similar to those of Embodiment 6 are not described.

Figure 31:
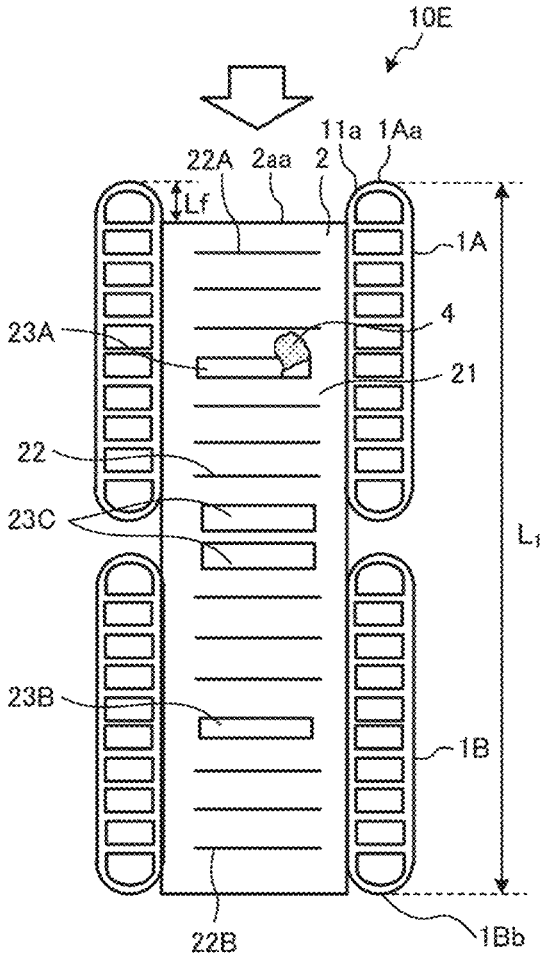
FIG. 31 is an enlarged schematic plan view of part of a heat exchanger according to Embodiment 7.

FIG. 31 is an enlarged schematic plan view of part of a heat exchanger according to Embodiment 7. The heat exchanger 10E of Embodiment 7 is formed such that a furthest windward distal end 2*aa* (hereinafter referred to as "windward distal end 2*aa*") of the corrugated fin 2 in the direction of flow of air (i.e. the direction of an arrow outlined with a blank inside in FIG. 31) is depressed further leeward than the furthest windward distal ends 1Aa (hereinafter referred to as "windward distal ends 1Aa") of the flat heat-transfer tubes 1A in the direction of flow of air. Looked at differently, the heat exchanger 10E of Embodiment 7 is formed such that the windward distal ends 1Aa of the flat heat-transfer tubes 1A in the direction of flow of air protrude further windward than the windward distal end 2*aa* of the corrugated fin 2. It should be noted that the flat heat-transfer tubes 1A are flat heat-transfer tubes of the furthest windward row of the plurality of (here, two) rows in which the flat heat-transfer tubes 1 are placed. $L_1$ is the length of the heat exchanger 10E in the direction of flow of air, and is the distance in the direction of flow of air between the windward distal end 1Aa of a flat heat-transfer tube 1A and a furthest leeward distal end 1Bb (hereinafter referred to as "leeward distal end 1Bb") of a flat heat-transfer tube 1B.

The following describes the workings of the foregoing configuration.

In a case in which the heat exchanger 10E is used as an evaporator, refrigerant below freezing flows through inside the heat-transfer tubes, and air passes through the heat exchanger 10E; meanwhile, the air is cooled by sequentially exchanging heat with the refrigerant inside the heat-transfer tubes while passing through the heat exchanger 10E from the windward side to the leeward side. Then, the air thus cooled causes condensed water to be produced on the fin surfaces. In the heat exchanger 10E, the temperature difference between the refrigerant and the air increases toward the windward side, and the amount of heat exchange increases toward the windward side. For this reason, the amount of condensed water that is produced on the fin surfaces increases toward the windward side of the heat exchanger 10E, and the amount of frost formation too increases toward the windward side of the heat exchanger 10E.

In the heat exchanger 10E, projecting portions 11*a* projecting further windward than the corrugated fin 2 and including the distal ends 1Aa of the flat heat-transfer tubes 1A are portions in which frost formation tends to occur. Note here that since the heat exchanger 10E is formed such that the distal end 2*aa* of the corrugated fin 2 is depressed further leeward than the windward distal ends 1Aa of the flat heat-transfer tubes 1A in the direction of flow of air, the heat exchanger 10E can provide wide space for frost formation. Since the heat exchanger 10E can provide wide space for frost formation, the heat exchanger 10E can reduce the temperature difference between the fin section 24 per se and the air on the windward side.

Note here that the space for frost formation is a space around portions of windward parts of the plurality of flat heat-transfer tubes 1A located windward of FIG. 31 in which the corrugated fin 2 is not provided, and to the extent that no fin exists, a large space in which frost can form can be secured. Further, in the windward parts of the plurality of flat heat-transfer tubes 1A, in which no fin exits, the heat transfer coefficient is small, so that the amount of heat exchange can be reduced. That is, the heat exchanger 10E can reduce the amount of frost formation. This allows the heat exchanger 10E to ensure an almost uniform amount of frost formation on the fin section 24 in the direction of flow of air, making it possible to improve heating capacity under low-temperature air conditions.

Further, during defrosting operation through which frost formed on the corrugated fin 2 is melted, the heat exchanger 10E can drain a large portion of the amount of frost formation through the projecting portions 11*a* of the flat heat-transfer tubes 1A, so that improvement in defrosting performance can be expected. Further, since no corrugated fin 2 exits in the projecting portions 11*a* of the flat heat-transfer tubes 1A, frost having adhered to the projecting portions 11*a* may fall along surfaces of the projecting portions 11*a* in a half-melted state in which the frost is yet to completely become condensed water, so that the heat exchanger 10E can improve drainage capacity.

The inventors found through an example of an experiment a relationship between the amount of depression of a corrugated fin 2 and an effect of improvement in low-temperature heating capacity by uniformizing of the amount of frost formation. This point is explained below.

Figure 32:
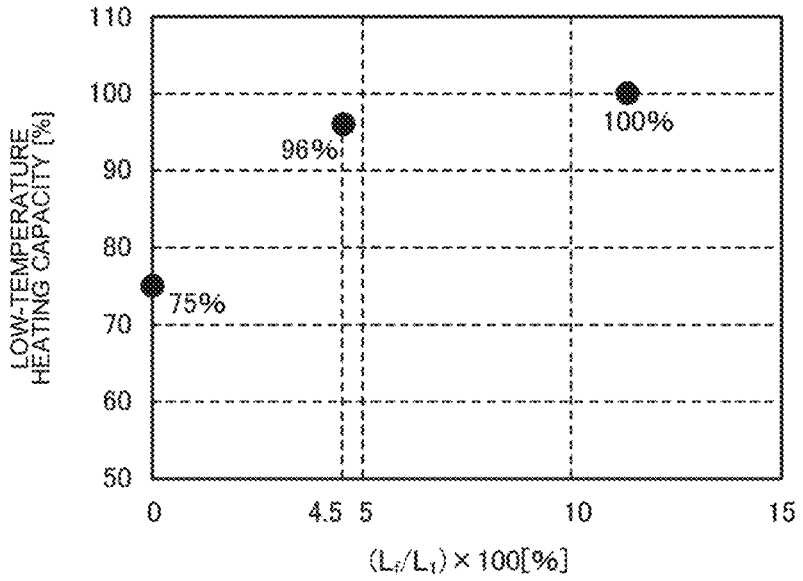
FIG. 32 is a diagram showing a relationship between $(L_f/L_1)\times100$ and low-temperature heating capacity in the heat exchanger according to Embodiment 7.

FIG. 32 is a diagram showing a relationship between $(L_f/L_1)\times100$ and low-temperature heating capacity in the heat exchanger according to Embodiment 7. In FIG. 32, the horizontal axis represents $(L_f/L_1)\times100$ [%], and the vertical axis represents low-temperature heating capacity [%]. $L_f$ is the amount of depression of a corrugated fin 2, and is the distance in the direction of flow of air between the windward distal end 2*aa* of the corrugated fin 2 and the windward distal end 1Aa of a flat heat-transfer tube 1A. $L_1$ is the length of the heat exchanger 10E in the direction of flow of air, and is the distance in the direction of flow of air between the windward distal end 1Aa of a flat heat-transfer tube 1A and the leeward distal end 1Bb of a flat heat-transfer tube 1B. The vertical axis shows a result of improvement in low-temperature heating capacity in comparison with a configuration in which there are no projecting portions 11*a* where the low-temperature heating capacity in a case in which there are no projecting portions 11*a* is 50%.

As shown in FIG. 32, it was confirmed that when $(L_f/L_1)\times100$ is higher than or equal to 4.5%, great improvement in low-temperature heating capacity can be brought about with a 46% increase in low-temperature heating capacity in comparison with the configuration in which there are no projecting portions 11*a*. It should be noted that excessively increasing the amount of projection $L_f$ or, in other words, excessively increasing the amount of depression of the corrugated fin 2 requires a structure for ensuring a desired heat-transfer area, as the area of the fin section 24 decreases. Specific examples of the structure for ensuring a desired heat-transfer area include increasing the dimensions of the heat-transfer tubes and the corrugated fin 2. This structure leads to a great decrease in cost performance. For this reason, in consideration of the balance between the effect of improvement in low-temperature heating capacity and the ensuring of a heat-transfer area, it is preferable that $L_f$ be as small as possible.

According to FIG. 32, there is improvement in low-temperature heating capacity when $(L_f/L_1)\times100$ is higher than 0% and lower than or equal to 11%. When $L_f/L_1$ exceeds 11%, a decrease in heat-transfer area becomes remarkable for the effect of improvement in low-temperature heating capacity. For this reason, a configuration in which $L_f/L_1$ is higher than 0% and lower than or equal to 11% is preferable.

Figure 33:
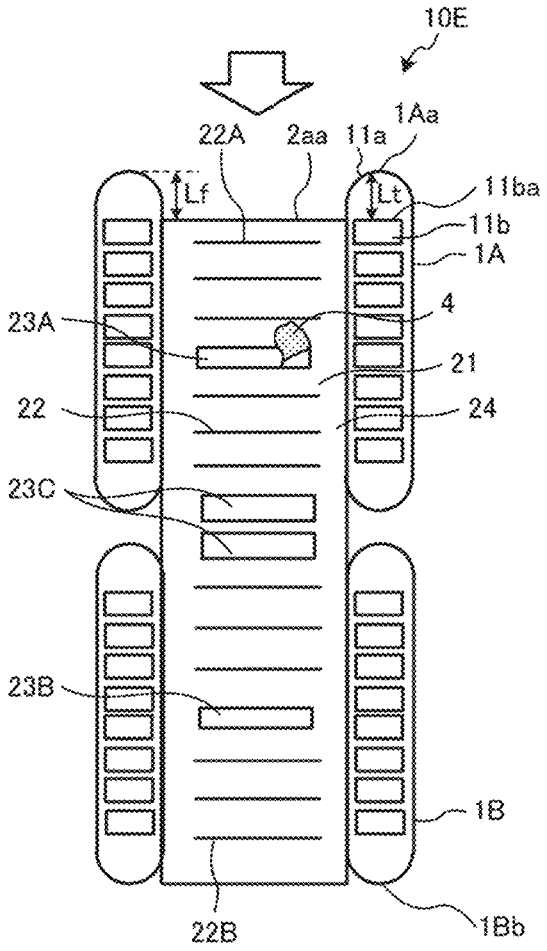
FIG. 33 is a diagram showing a relationship between the amount of depression of a corrugated fin and a refrigerant flow passage inside a flat heat-transfer tube in Embodiment 7.

FIG. 33 is a diagram showing a relationship between an amount of depression of a corrugated fin and a refrigerant flow passage inside a flat heat-transfer tube in Embodiment 7. In FIG. 33, $L_t$ is the distance in the direction of flow of air between the windward distal end 1Aa of a flat heat-transfer tube 1A and a windward distal end 11*ba* of a refrigerant flow passage 11*b* inside the flat heat-transfer tube 1A. The heat exchanger 1E satisfies the relationship $L_t \geq L_f$. In the configuration in which this relationship is satisfied, the flat heat-transfer tube 1A is formed to have no refrigerant flow passages 11*b* formed in the range in which the corrugated fin 2 is depressed in the direction of flow of air. In other words, in the configuration in which this relationship is satisfied, there are no refrigerant flow passages 11*b* formed in the projecting portions 11*a*. For this reason, the temperature of the projecting portions 11*a* can be made relatively higher than the refrigerant temperature. This allows the heat exchanger 10E to reduce the temperature difference between the projecting portions 11*a* per se and air and prevent frost from being intensively formed on the projecting portions 11*a*, making it possible to achieve uniform frost formation in a windward part of the heat exchanger 10E. As a result of that, the heat exchanger 10E can improve low-temperature heating capacity. Further, through uniform formation of frost, the heat exchanger 10E can improve defrosting performance and drainage performance.

[Effects]

As described above, the heat exchanger 10E of Embodiment 7 can bring about the following effects in addition to effects that are similar to those of Embodiment 6. The heat exchanger 10E is formed such that the windward distal end 2*aa* of the corrugated fin 2 is depressed further leeward than the windward distal ends 1Aa of the flat heat-transfer tubes 1A located windward. For this reason, the heat exchanger 10E can reduce the temperature difference between the fin section 24 per se and the air on the windward side, making it possible to ensure an almost uniform amount of frost formation on the fin section 24 in the direction of flow of air. As a result of that, the heat exchanger 10E can improve heating capacity under low-temperature air conditions.

Further, by satisfying the relationship $L_t \geq L_f$, the heat exchanger 10E can achieve uniform frost formation in the windward part of the heat exchanger 10E by preventing frost from being unevenly formed on the projecting portion 11*a*. As a result of that, the heat exchanger 10E can improve low-temperature heating capacity. Further, through uniform formation of frost, the heat exchanger 10E can improve defrosting performance and drainage performance.

REFERENCE SIGNS LIST

1: flat heat-transfer tube, 1A: flat heat-transfer tube, 1B: flat heat-transfer tube, 1*a*: flat surface, 1Aa: windward distal end (furthest windward distal end), 1Ab: leeward distal end (furthest leeward distal end), 1Ba: windward distal end (furthest windward distal end), 1Bb: leeward distal end (furthest leeward distal end), 2: corrugated fin, 2*a*: upstream protruding portion, 2*aa*: windward distal end (furthest windward distal end), 3: header, 3A: header, 38: header, 4: condensed water, 10: heat exchanger, 10A: heat exchanger, 10B: heat exchanger, 10C: heat exchanger, 10D: heat exchanger, 10E: heat exchanger, 11*ba*: windward distal end, 20: apex, 20*a*: drain apex, 20*b*: non-drain apex, 21: flat-plate portion, 21*a*: non-junction region, 21A: water conduit, 22: louver, 22A: first louver group, 228: second louver group, 22*a*: louver slit, 22*b*: plate portion, 23: drain slit, 23A: first drain slit, 238: second drain slit, 23C: interrow drain slit, 23*a*: opening, 24: fin section, 24A: fin section, 248: fin section, 24C: fin section, 30: apex built-up portion, 50: fin material, 100: indoor unit, 110: indoor heat exchanger, 120: decompression device, 130: indoor fan, 200: outdoor unit, 210: compressor, 220: four-way valve, 230: outdoor heat exchanger, 240: outdoor fan, 300: gas refrigerant pipe, 400: liquid refrigerant pipe, 500: fin material, 500*a*: opening, 501: corrugated cutter, 502: corrugated cutter, 503: heat-transfer region, 504: center line

The invention claimed is:

1. A heat exchanger comprising:

a plurality of flat heat-transfer tubes each formed in a flat shape in cross-section, provided with a plurality of flow passages formed by through holes, disposed to stand in an up-down direction, and placed side by side and spaced from one another in a direction orthogonal to a direction of flow of air, and a corrugated fin placed between the plurality of flat heat-transfer tubes, the corrugated fin being formed such that fin sections that are plate-shaped are joined together one after another in a wave shape in a tube axial direction of the plurality of flat heat-transfer tubes, the fin sections each having a drain slit formed such that the drain slit extends in a tube side-by-side placement direction that is a direction in which the plurality of flat heat-transfer tubes are placed side by side and through which water on an upper surface of the fin section falls for drainage, and a plurality of louvers each having a louver slit extending in the tube side-by-side placement direction and a plate portion inclined to a flat-plate portion that is tabular-shaped in the fin section, the plurality of louvers being divided into a first louver group formed further upstream in the direction of flow of air than the drain slit and a second louver group formed further downstream in the direction of flow of air than the drain slit, the plate portions of the first louver group and the plate portions of the second louver group being inclined to the flat-plate portion and inclined in respective directions that are opposite to each other, the drain slit comprising a plurality of drain slits formed between the first louver group and the second louver group at an interval in the direction of flow of air, the plurality of flat heat-transfer tubes are placed in a plurality of rows and are spaced from one another in the direction of flow of air, the corrugated fin is provided commonly for the plurality of rows, the corrugated fin has the plurality of louvers and the plurality of drain slits formed in correspondence with each adjacent two of the plurality of rows, a plurality of interrow drain slits are formed in a position corresponding to a space between adjacent two of the plurality of rows in the direction of flow of air, and an opening area of each of the plurality of interrow drain slits is larger than an opening area of each of the plurality of drain slits.

2. The heat exchanger of claim 1, wherein the interval between the plurality of drain slits is shorter than a length Ss of each of the plurality of drain slits in the direction of flow of air.

3. The heat exchanger of claim 1, wherein when $\delta_1$ is a length in the direction of flow of air of a water conduit that is a portion of the flat-plate portion situated between the plurality of drain slits and $\delta_2$ is a distance in the direction of flow of air between one of the plurality of louvers and one of the plurality of drain slits that are adjacent to each other in the direction of flow of air, $\delta_1<\delta_2$ is satisfied.

4. The heat exchanger of claim 3, wherein the water conduit has a shape of a long plate whose long side extends in the tube side-by-side placement direction and whose short side extends in the direction of flow of air.

5. The heat exchanger of claim 1, wherein the flat-plate portion has two ends in the tube side-by-side placement direction and the fin section has, at each of the two ends of the flat-plate portion, an apex joined to the plurality of flat heat-transfer tubes, and one of a plurality of the fin sections has one of the plurality of drain slits formed in a position at which the one of the plurality of drain slits overlaps the apex at one or each of the two ends when the one of the plurality of drain slits is seen from an angle parallel with the tube axial direction.

6. The heat exchanger of claim 5, wherein one of the plurality of the fin sections has one of the plurality of drain slits formed in a position at which the one of the plurality of drain slits does not overlap the apex at each of the two ends when the one of the plurality of drain slits is seen from an angle parallel with the tube axial direction.

7. The heat exchanger of claim 1, wherein the corrugated fin has an upstream protruding portion protruding further upstream than the plurality of flat heat-transfer tubes and having a thickness that is greater than a thickness of a portion of the corrugated fin that is other than the upstream protruding portion.

8. The heat exchanger of claim 7, wherein the upstream protruding portion of the corrugated fin is thickened by folding back a portion of the fin section protruding further upstream than the plurality of flat heat-transfer tubes.

9. The heat exchanger of claim 1, wherein ones of the plurality of drain slits in ones of the fin sections adjacent to each other in the tube axial direction are displaced from each other in the tube side-by-side placement direction.

10. The heat exchanger of claim 1, wherein the corrugated fin is formed such that ones of the fin sections identical in position of ones of the plurality of drain slits to each other in the direction of flow of air are periodically and repeatedly located in the tube axial direction.

11. A heat exchanger comprising:

a plurality of flat heat-transfer tubes each formed in a flat shape in cross-section, provided with a plurality of flow passages formed by through holes, disposed to stand in an up-down direction, and placed side by side and spaced from one another in a direction orthogonal to a direction of flow of air; and a corrugated fin placed between the plurality of flat heat-transfer tubes, the corrugated fin being formed such that fin sections that are plate-shaped are joined together one after another in a wave shape in a tube axial direction of the plurality of flat heat-transfer tubes, the fin sections each having a drain slit formed such that the drain slit extends in a tube side-by-side placement direction that is a direction in which the plurality of flat heat-transfer tubes are placed side by side and through which water on an upper surface of the fin section falls for drainage, and a plurality of louvers each having a louver slit extending in the tube side-by-side placement direction and a plate portion inclined to a flat-plate portion that is tabular-shaped in the fin section, the plurality of louvers being divided into a first louver group formed further upstream in the direction of flow of air than the drain slit and a second louver group formed further downstream in the direction of flow of air than the drain slit, the plate portions of the first louver group and the plate portions of the second louver group being inclined to the flat-plate portion and inclined in respective directions that are opposite to each other, the drain slit comprising a plurality of drain slits formed between the first louver group and the second louver group at an interval in the direction of flow of air, the plurality of flat heat-transfer tubes are placed in a plurality of rows and are spaced from one another in the direction of flow of air, the corrugated fin is provided commonly for the plurality of rows, the corrugated fin has the plurality of louvers and the plurality of drain slits formed in correspondence with each adjacent two of the plurality of rows, a plurality of interrow drain slits are formed in a position corresponding to a space between adjacent two of the plurality of rows in the direction of flow of air, and wherein when $A_A$ is an opening area of one of the plurality of drain slits formed in a middle of the first louver group in the direction of flow of air, $A_B$ is an opening area of one of the plurality of drain slits formed in a middle of the second louver group in the direction of flow of air, and $A_c$ is an opening area of the interrow drain slit, $A_C>A_A+A_B$ is satisfied.

12. A heat exchanger comprising:

a plurality of flat heat-transfer tubes each formed in a flat shape in cross-section, provided with a plurality of flow passages formed by through holes, disposed to stand in an up-down direction, and placed side by side and spaced from one another in a direction orthogonal to a direction of flow of air; and a corrugated fin placed between the plurality of flat heat-transfer tubes, the corrugated fin being formed such that fin sections that are plate-shaped are joined together one after another in a wave shape in a tube axial direction of the plurality of flat heat-transfer tubes, the fin sections each having a drain slit formed such that the drain slit extends in a tube side-by-side placement direction that is a direction in which the plurality of flat heat-transfer tubes are placed side by side and through which water on an upper surface of the fin section falls for drainage, and a plurality of louvers each having a louver slit extending in the tube side-by-side placement direction and a plate portion inclined to a flat-plate portion that is tabular-shaped in the fin section, the plurality of louvers being divided into a first louver group formed further upstream in the direction of flow of air than the drain slit and a second louver group formed further downstream in the direction of flow of air than the drain slit, the plate portions of the first louver group and the plate portions of the second louver group being inclined to the flat-plate portion and inclined in respective directions that are opposite to each other, the drain slit comprising a plurality of drain slits formed between the first louver group and the second louver group at an interval in the direction of flow of air, the plurality of flat heat-transfer tubes are placed in a plurality of rows and are spaced from one another in the direction of flow of air, the corrugated fin is provided commonly for the plurality of rows, the corrugated fin has the plurality of louvers and the plurality of drain slits formed in correspondence with each adjacent two of the plurality of rows, a plurality of interrow drain slits are formed in a position corresponding to a space between adjacent two of the plurality of rows in the direction of flow of air, and wherein the plurality of drain slits comprises one drain slit formed in a middle of the first louver group in the direction of flow of air and one drain slit formed in a middle of the second louver group in the direction of flow of air, and the interrow drain slit comprises a plurality of interrow drain slits.

13. The heat exchanger of claim 1, wherein the interrow drain slit is formed in a portion of the fin section situated between respective distal ends of the plurality of flat heat-transfer tubes of rows adjacent to each other in the direction of flow of air and the respective distal ends are opposite to each other.

14. The heat exchanger of claim 1, wherein a distal end of the corrugated fin in the direction of flow of air is depressed further leeward than windward distal ends of the plurality of flat heat-transfer tubes of a furthest windward row of the plurality of rows in which the plurality of flat heat-transfer tubes are placed.

15. The heat exchanger of claim 14, wherein in the plurality of flat heat-transfer tubes of the furthest windward row, the plurality of flow passages are not formed in a range in which the corrugated fin is depressed in the direction of flow of air.

16. The heat exchanger of claim 14, wherein when $L_f$ is an amount of depression of the corrugated fin and $L_1$ is a length of the heat exchanger in the direction of flow of air, $(L_f/L_1)\times100$ is greater than 0% and less than or equal to 11%.

17. A refrigeration cycle apparatus comprising the heat exchanger of claim 1.

* * * * *